US007556146B2

(12) United States Patent
Takata

(10) Patent No.: US 7,556,146 B2
(45) Date of Patent: Jul. 7, 2009

(54) PACKAGE INCLUDING CONTAINER AND METHOD OF PACKING, WITH PACKING KIT, CONTAINER TO PROVIDE PACKAGE

(75) Inventor: Masayuki Takata, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 676 days.

(21) Appl. No.: 11/362,175

(22) Filed: Feb. 27, 2006

(65) Prior Publication Data

US 2006/0191806 A1 Aug. 31, 2006

(30) Foreign Application Priority Data

Feb. 25, 2005 (JP) ..... 2005-050636

(51) Int. Cl.
*B65D 81/28* (2006.01)

(52) U.S. Cl. ..... 206/213.1; 206/521; 206/594; 53/403

(58) Field of Classification Search ..... 206/521, 206/594, 591, 592, 213.1, 223, 576; 347/2, 347/28, 86, 100, 108; 53/403, 405, 408, 53/432

See application file for complete search history.

(56) References Cited

U.S. PATENT DOCUMENTS 5,244,087 A * 9/1993 Hikake et al. ..... 206/701
5,934,475 A * 8/1999 Hikake et al. ..... 206/722
6,062,390 A 5/2000 Nakamura
6,220,702 B1 * 4/2001 Nakamura et al. ..... 347/86
7,093,710 B2 * 8/2006 Shimizu et al. ..... 206/213.1
7,137,693 B2 * 11/2006 Toyoda et al. ..... 347/100
2004/0134801 A1 * 7/2004 Shimizu et al. ..... 206/213.1

FOREIGN PATENT DOCUMENTS

JP 7 89086 4/1995
JP 11 1046 1/1999
JP 2004 237566 8/2004

* cited by examiner

*Primary Examiner*—David T Fidei
(74) *Attorney, Agent, or Firm*—Baker Botts L.L.P.

(57) ABSTRACT

A packing kit for packing a container which contains a fluid together with a first gas, and thereby providing a package including the container, the packing kit including a packing bag which is adapted to fluid-tightly accommodate the container together with a second gas, a non-gas-tight case which accommodates the packing bag together with a third gas and which has a rigidity to restrain an expansion of the packing bag in a low-pressure environment where a portion of the third gas leaks from the non-gas-tight case and accordingly a pressure of the third gas becomes lower than a pressure of the second gas, and a volume-ratio reducing device which is provided inside of at least the non-gas-tight case so as to reduce a ratio of a volume of the third gas to a volume of the second gas.

24 Claims, 11 Drawing Sheets

PACKAGE INCLUDING CONTAINER AND METHOD OF PACKING, WITH PACKING KIT, CONTAINER TO PROVIDE PACKAGE

The present application is based on Japanese Patent Application No. 2005-050636 filed on Feb. 25, 2005, the contents of which are incorporated herein by reference.

BACKGROUND OF THE INVENTION

1. Field of the Invention

The present invention relates to a packing kit for packing a fluid-containing container to provide a package; a package including a packing kit and a fluid-containing container packed by the packing kit; and a method of packing, with a packing kit, a fluid-containing container to provide a package.

2. Discussion of Related Art

There has been widely used an inkjet recording device including a recording head that ejects droplets of ink and records an image on a recording medium. The inkjet recording device additionally includes an ink tank that stores a large amount of ink. The ink is supplied from the ink tank to the recording head via a tube, so that the ink is introduced into an ink reservoir of the recording head.

The recording head ejects, from an open end (i.e., an ink ejection outlet) of each of a plurality of ink ejection nozzles each communicating with the ink reservoir, a droplet of ink so as to record an image on a recording medium. The recording head has a nozzle-opening surface in which the nozzles open and are arranged in a plurality of arrays in a zigzag or staggered fashion, and which is opposed to the recording medium such as a recording sheet.

When the inkjet recording device records images on a recording sheet, the recording head is reciprocated in a widthwise direction of the recording sheet (i.e., a primary scanning direction). Consequently the tube connected to the recording head is moved together with the head, so that the ink present in the tube is oscillated. If the oscillation (i.e., dynamic pressure) of the ink, produced in the tube, is transmitted to the ink temporarily stored by the recording head, then an ink ejection performance of the head is adversely influenced, which leads to lowering a recording quality of the recording device. To avoid this problem, the recording head has, above the ink reservoir, a space (i.e., an air layer) that absorbs the dynamic pressure of the ink. That is, the recording head is constructed such that the ink supplied from the ink tank is introduced into the ink reservoir via the air layer. According to this arrangement, the ink in the tube and the ink in the ink reservoir are separated from each other by the air layer. Therefore, the dynamic pressure produced in the ink in the tube is absorbed by the air layer, and is not transmitted to the ink in the ink reservoir.

The recording head is an article of consumption and is commercially available. When the recording head is shipped from a factory, a maintenance liquid for maintaining the head is charged into the ink reservoir (i.e., an inner space) of the head, for the purpose of enabling, when the head is initially attached to the inkjet recording device, an ink to be smoothly introduced into the ink reservoir, without generating air bubbles in the ink. The maintenance liquid has the same properties as those of the ink but does not contain a dye or a pigment of the ink. In addition, when the recording head is shipped from the factory, the head is packed with a packing kit, for the purposes of avoiding contamination and absorbing shock. The packing kit includes a rubber-based nozzle protector that is attached to the nozzle-opening surface of the head, for the purpose of fluid-tightly sealing the respective ink ejection outlets of the nozzles; and a flexible sheet in the form of an inflatable bag that accommodates the head. Thus, the recording head is packed by the packing kit, such that the ink ejection outlets are fluid-tightly sealed by the nozzle protector, i.e., the inner space of the head is fluid-tightly closed, and such that the head is fluid-tightly accommodated by the bag. An example of the inkjet recording device is disclosed by, e.g., Japanese Patent Application Publication No. 11-1046 or its corresponding U.S. Pat. No. 6,062,390A.

SUMMARY OF THE INVENTION

However, the above-indicated recording head may be transported as air freight. In this case, the recording head is subjected to a low-pressure environment whose atmospheric pressure is lower than an atmospheric pressure in which the head is produced, i.e., a maintenance liquid and an appropriate gas (e.g., air) is charged into the head. If an air pressure in the inner space of the bag accommodating the recording head is lowered, then an air pressure in the fluid-tight inner space of the head becomes higher than the air pressure outside of the head. When this pressure difference exceeds a reference value, a portion of the air present in an inner space of the nozzle protector (i.e., a space defined by the protector and the nozzle-opening surface of the head) leaks to the outside. If the air leaks, then a portion of the maintenance liquid leaks to the inner space of the protector via the nozzles and eventually leaks to the outside of the head.

If the nozzle protector is strongly pressed against the nozzle-opening surface of the recording head, so as not to cause the leakage of the maintenance liquid from the recording head in the low-pressure environment, the leakage may be prevented. In this case, however, an excessively great load is applied to the nozzle-opening surface. More specifically described, if the nozzle protector is strongly and constantly pressed against the nozzle-opening surface, then the surface is pushed backward (i.e., in a direction opposite to the direction of ejection of ink) from its initial position (i.e., its nominal position). Therefore, in a state in which the recording head is actually attached to the inkjet recording device, the nozzle-opening surface of the head is located at a position remoter from a recording sheet than the nominal position. This leads to lowering a sheet-hitting force of the ink droplets ejected by the recording head.

Meanwhile, if the recording head is accommodated or packed with such a fluid-tight container (e.g., a duralumin case or a desiccator) that is formed of a rigid material (e.g., metal, glass, or ceramics), an air pressure in the fluid-tight container can be maintained even in the above-described low-pressure environment and accordingly the leakage of the fluid (i.e., the maintenance liquid) can be prevented. However, the fluid-tight container costs high.

It is therefore an object of the present invention to solve at least one of the above-identified problems. It is another object of the present invention to provide a packing kit that can pack a container containing a fluid, while preventing leakage of the fluid from the container even in a low-pressure environment, and that can be produced at low cost. It is another object of the present invention to provide a package including a packing kit and a fluid-containing container packed by the packing kit. It is another object of the present invention to provide a method of packing, with a packing kit, a fluid-containing container to provide a package including the container.

According to a first aspect of the present invention, there is provided a packing kit for packing a container which contains a fluid together with a first gas, and thereby providing a package including the container, the packing kit comprising a packing bag which fluid-tightly accommodates the container together with a second gas; a non-gas-tight case which is adapted to accommodate the packing bag together with a third gas and which has a rigidity to restrain an expansion of the packing bag in a low-pressure environment where a portion of the third gas leaks from the non-gas-tight case and accordingly a pressure of the third gas becomes lower than a pressure of the second gas; and a volume-ratio reducing device which is provided inside of at least the non-gas-tight case so as to reduce a ratio of a volume of the third gas to a volume of the second gas. The container may be a recording head containing a maintenance liquid together with a gas (e.g., air). The first, second, and third gases may be different sorts of gases, or a same sort of gas such as air.

In the low-pressure environment, since an atmospheric pressure outside of the non-gas-tight case is lower than the pressure of the third gas, a portion of the third gas leaks from the non-gas-tight case and accordingly the pressure of the third gas becomes lower than the pressure of the second gas. According to this invention, however, since the volume-ratio reducing device is provided inside of the non-gas-tight case so as to reduce the ratio of the volume of the third gas to the volume of the second gas, an amount of change of the volume, or the pressure, of the second gas is minimized. Thus, even in the low-pressure environment, the pressure of the second gas acting on the container accommodated by the packing bag does not change so largely from a pressure of the second gas in a normal-pressure environment where the fluid is charged into the container. In other words, even in the low-pressure environment, the balancing of the respective pressures of the first and second gases are well maintained like in the normal-pressure environment. Thus, the leakage of the fluid from the container can be effectively prevented.

According to a preferred feature of the first aspect of the present invention, the volume-ratio reducing device comprises a bag correcting device which is provided inside of the packing bag and outside of the container and which corrects, in a state in which the packing bag is accommodated by the non-gas-tight case, an external shape of the packing bag into a corrected shape approximating an internal shape of the non-gas-tight case.

According to this preferred feature, an outer surface of the packing bag having the corrected shape is located along an inner surface of the non-gas-tight case, i.e., is directly contacted with, or is kept distant by only a small distance from, the inner surface. Therefore, even in the low-pressure environment, the non-gas-tight case and the bag correcting device cooperate with each other to restrain an increase of the volume of the second gas and thereby restrain a decrease of the pressure of the same. If the packing bag accommodating the container expands in the low-pressure environment and accordingly the volume of the second gas increases, the pressure of the second gas lowers or decreases in reciprocal proportion with the increased volume of the second gas. Thus, the pressure of the second gas externally acting on the container decreases. However, the expansion of the packing bag is restrained by the rigidity of the non-gas-tight case. That is, the expansion of the packing bag reaches a limit when the packing bag is entirely contacted with the inner surface of the non-gas-tight case. Meanwhile, since the bag correcting device corrects the external shape of the packing bag into the corrected shape approximating the internal shape of the non-gas-tight case, a small amount of expansion of the packing bag, i.e., a small increase of the volume of the second gas suffices for reaching the limit of increasing of the volume. Thus, a large decrease of the pressure of the second gas can be effectively prevented.

If the pressure of the second gas largely decreases in the packing bag, the pressure of the first gas in the container becomes higher than the pressure of the second gas, so that the first gas acts on the fluid to push it out of the container. In the case where the container has an inlet through which the fluid is introduced into the container, or in the case where the sealing of the container is not sufficiently fluid-tight, the high pressure of the first gas causes the fluid to leak from the container into the packing bag. However, according to this preferred feature, even in the low-pressure environment, the pressure of the second gas can be maintained, and accordingly the balancing of the respective pressures of the first and second gases can be maintained like in the normal-pressure environment. Thus, the fluid can be effectively prevented from leaking from the container.

The packing kit needs to have a construction to restrain the expansion of the packing bag. Therefore, the packing bag may be formed of an inexpensive common resin material such as a polyolefine resin, a polyester resin, a vinyl resin, a polyamide resin, or an acrylic resin. In particular, the non-gas-tight case needs to have a rigidity to restrain the expansion of the packing bag. For example, the non-gas-tight case may be a paper-based container such as a corrugated-cardboard box, or a resin-based container having a thickened wall. Since the present packing kit can be produced using inexpensive materials, the packing kit can enjoy a low production cost.

According to another preferred feature of the first aspect of the present invention, the volume-ratio reducing device comprises a gas-tight bag which gas-tightly accommodates a fourth gas and which is provided inside of the non-gas-tight case and outside of the packing bag.

In the low-pressure environment, the pressure of the third gas outside of the gas-tight bag is lower than the pressure of the fourth gas, and accordingly the gas-tight bag expands. However, the rigidity of the non-gas-tight case restrains the expansion of the gas-tight bag, and the restrained expansion of the gas-tight bag applies a pressing force to the packing bag, so that the non-gas-tight case and the gas-tight bag cooperate with each other to restrain an increase of the volume of the second gas and thereby restrain a decrease of the pressure of the second gas.

According to a second aspect of the present invention, there is provided a package, comprising a container which contains a fluid together with a first gas; and the packing kit according to the first aspect of the present invention, wherein the packing kit packs the container and thereby provides a package including the container.

According to a third aspect of the present invention, there is provided a method of packing, with the packing kit according to the first aspect of the present invention, a container which contains a fluid together with a first gas, and thereby providing a package including the container, the method comprising inserting, in a state in which the packing bag has an opening, at least the container into the packing bag through the opening thereof, closing the opening of the packing bag in a state in which a holding portion of the packing bag in which at least the container is held is communicated with an outside of the packing bag through a communication passage formed in the packing bag, placing, in a state in which the non-gas-tight case has an opening, the packing bag in the non-gas-tight case through the opening thereof, folding, in a state in which the packing bag is placed in the non-gas-tight case, a surplus portion of the packing bag, while discharging a surplus portion of the second gas from the packing bag through the communication passage thereof, and fluid-tightly closing the communication passage of the packing bag, and then closing the opening of the non-gas-tight case.

In the present method, in the state in which the packing bag is placed in the non-gas-tight case, the surplus portion of the packing bag is folded up while discharging the surplus portion of the second gas from the packing bag through the communication passage thereof. Therefore, the surplus portion of the second gas relative to the inner volume of the non-gas-tight case is not left in the case, after the packing bag is fluid-tightly closed. That is, the volume of the packing bag is controlled not to exceed the volume of the non-gas-tight case. Thus, the present method is freed of a problem that the packing bag, fluid-tightly closed, cannot be accommodated by the non-gas-tight case, i.e., it assures that the packing bag, fluid-tightly closed, can be appropriately accommodated by the case.

According to a fourth aspect of the present invention, there is provided a method of packing, with the packing kit according to the first aspect of the present invention, a container which contains a fluid together with a first gas, and thereby providing a package including the container, the method comprising inserting, in a state in which the packing bag has an opening, at least the container into the packing bag through the opening thereof, placing, in a state in which the non-gas-tight case has an opening, the packing bag in the non-gas-tight case through the opening thereof, and fluid-tightly closing, in a state in which the packing bag is placed in the non-gas-tight case, the opening of the packing bag, and then closing the opening of the non-gas-tight case.

In the present method, in the state in which the packing bag is placed in the non-gas-tight case, the opening of the packing bag is fluid-tightly closed. Therefore, the surplus portion of the second gas relative to the inner volume of the non-gas-tight case (more specifically described, relative to a difference of the inner volume of the case and a volume of the container) can be discharged through the opening of the packing bag. Therefore, in contrast to the case where first the opening of the packing bag is fluid-tightly closed and then the closed packing bag is placed in the non-gas-tight case, the present method is freed of a problem that the packing bag, fluid-tightly closed, cannot be accommodated by the non-gas-tight case, i.e., it assures that the packing bag, fluid-tightly closed, can be appropriately accommodated by the case.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
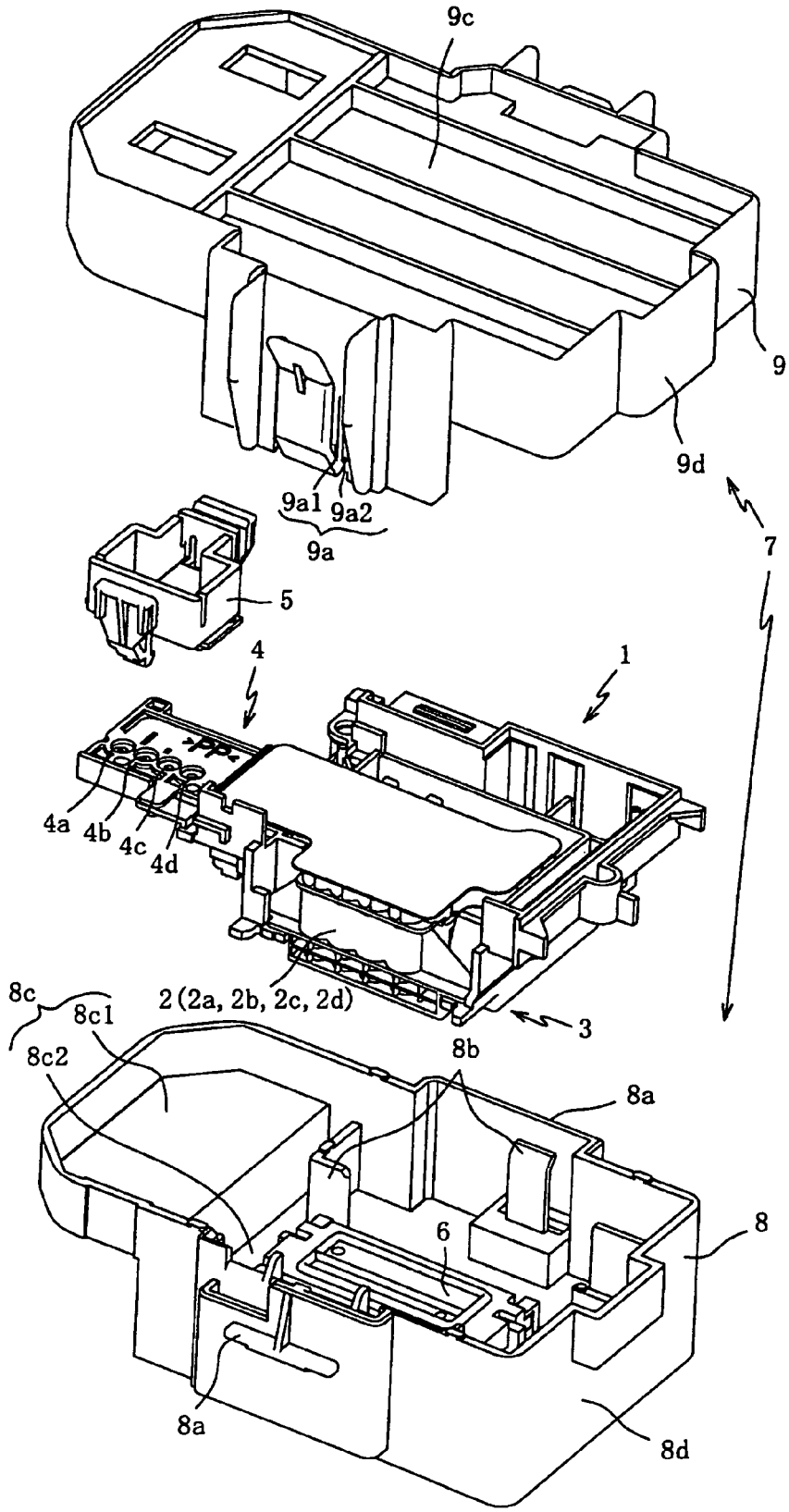
FIG. 1 is a perspective view of a recording head and a sealing case that fluid-tightly seals the recording head and that is packed with a packing kit to obtain a package, in a first embodiment of the present invention.

Hereinafter, there will be described preferred embodiments of the present invention by reference to the drawings. FIG. 1 shows a first embodiment in which a sealing case 7 that fluid-tightly seals a recording head 1 is packed with a packing kit 20 (FIG. 2) to obtain a package 10, described later.

The recording head 1 incorporates a piezoelectric actuator (not shown) that operates for ejecting droplets of plural sorts of inks, supplied to the head 1, toward a recording medium such as a recording sheet, so as to record an image on the sheet. The recording head 1 is employed by an ink-jet recording device. The recording head 1 is connected via tubes (not shown) to ink cartridges (not shown) that are detachably attached to the ink-jet recording device, and is supplied with respective sorts of inks from the ink cartridges.

The recording head 1 includes an ink reservoir or tank 2 that temporarily stores the inks supplied from the ink cartridges. The ink tank 2 includes four ink chambers 2*a*, 2*b*, 2*c*, 2*d* corresponding to four sorts of inks, i.e., a cyan ink, a magenta ink, a yellow ink, and a black ink.

Each of the ink chambers 2*a* through 2*d* has, above the stored ink, a space (i.e., an air layer) that is not charged with the ink and is filled with air, and the ink is supplied from the corresponding ink cartridge to the each ink chamber 2*a* through 2*d* via the air layer.

The recording head 1 is mounted on a carriage (not shown) that is movable in a widthwise direction of the recording sheet (i.e., in a primary scanning direction) in the ink-jet recording device. When the recording head 1 performs a recording operation, the head 1 is reciprocated, with the carriage, in the widthwise direction of the recording sheet, while the head 1 ejects droplets of inks toward the sheet. In the recording operation, the above-described tubes, connected to the recording head 1, are moved with the carriage, and the inks present in the tubes are vibrated. If the vibration (i.e., dynamic pressure) of the inks in the tubes is transmitted to the inks stored in the ink chambers 2*a* through 2*d*, an ink ejecting performance of the recording head 1 is adversely influenced and a quality of recording of the head 1 is lowered. To avoid this problem, the above-described air layer is provided in each of the ink chambers 2*a* through 2*d*, so as to isolate the inks in the chambers 2*a* through 2*d*, from the vibration produced in the inks in the tubes. Thus, the dynamic pressure produced in each of the tubes can be prevented from being transmitted to the ink stored in a corresponding one of the ink chambers 2*a* through 2*d*.

The recording head 1 has, as a bottom surface thereof opposed to the recording sheet, a nozzle-opening surface 3 having a plurality of nozzles (not shown) that are arranged in a staggered or zigzag fashion. The nozzles opening in the surface 3 are grouped into four groups that correspond to the four sorts of inks, i.e., the cyan, magenta, yellow, and black inks, respectively, and that communicate with the four ink chambers 2*a* through 2*d*, respectively. Thus, the four groups of nozzles are supplied with the four sorts of inks, respectively. The ink supplied to each of the nozzles is ejected from an open end of the each nozzle toward the recording sheet. The open end of each nozzle, through which the ink is ejected outward, will be referred to as the "ink ejection outlet". The ink supplied to the each nozzle has, at the ink ejection outlet, an exposed surface, i.e., a meniscus having a concave shape that is concaved from an inner cylindrical wall defining the outlet, toward a centerline of the each nozzle.

The recording head 1 includes an ink supply portion 4 that supplies the inks received from the ink cartridges, to the ink tank 2. The ink supply portion 4 projects outward from an upper and left-hand portion of the head 1, as seen in FIG. 1. The ink supply portion 4 has four ink supply inlets 4*a*, 4*b*, 4*c*, 4*d* that correspond to the four sorts of inks, respectively, and that communicate with the four ink chambers 2*a*, 2*b*, 2*c*, 2*d*, respectively. The four ink supply inlets 4*a*, 4*b*, 4*c*, 4*d* are connected via the respective tubes to the four ink cartridges that store the cyan, magenta, yellow, and black inks, respectively. Thus, the four sorts of inks are supplied from the four ink cartridges to the four ink chambers 2*a* through 2*d* via the respective tubes and the ink supply portion 4.

An upper surface of the ink supply portion 4, i.e., respective upper open ends of the four ink supply inlets 4*a* through 4*d* are fluid-tightly closed or sealed by a sealing cap 5. The sealing cap 5 has, on a lower surface thereof, four projecting portions (not shown) that fit in the four ink supply inlets 4*a* through 4*d*, respectively. Since the four projecting portions of the sealing cap 5 fit in the four ink supply inlets 4*a* through 4*d*, respectively, the sealing cap 5 fluid-tightly closes or seals the four ink supply inlets 4*a* through 4*d* of the recording head 1.

The sealing case 7 that seals the recording head 1 includes a main member 8 on which the head 1 is placed, and a lid member 9 that covers the main member 8. The main member 8 is formed by molding of a polyoxymethylene resin so as to have an interior shape corresponding to an exterior shape of the recording head 1. The main member 8 includes a bottom portion 8*c*, and a side portion 8*d* projecting upward from an outer periphery of the bottom portion 8*c*, has a generally rectangular shape in its plan view, and opens upward to receive the recording head 1.

The bottom portion 8*c* has a stepped shape including an upper portion (i.e., a first bottom portion) 8*c*1 and a lower portion (i.e., a second bottom portion) 8*c*2 that have different depths as measured from a top surface of the main member 8. The first bottom portion 8*c*1 is for supporting the ink supply portion 4 of the recording head 1, and is contacted with a lower surface of the ink supply portion 4. The second bottom portion 8*c*2 is for supporting the nozzle-opening surface 3 of the recording head 1, and holding portions 8*b* for holding the head 1 project upward from the second bottom portion 8*c*2. The holding portions 8*b* are formed to follow irregularity of respective exterior shapes of side surfaces of the recording head 1, such that the holding portions 8*b* do not occupy any spaces to be occupied by the head 1. Thus, the bottom portion 8*c* and the holding portions 8*b* cooperate with each other to hold the recording head 1 such that the head 1 is not movable from a prescribed position relative to the main member 8. In the present embodiment, a plurality of holding portions, not shown, other than the holding portions 8*b*, shown in FIG. 1, are provided along the side portion 8*d*. The above-described side surfaces of the recording head 1 are located between the nozzle-opening surface 3 as the lower surface of the head 1 and a top surface of the head 1 that is opposite to the bottom surface.

On the second bottom portion 8*c*2, a rubber seal member 6 as a maintenance cap is provided at a position where the rubber seal member 6 is opposed to the nozzle-opening surface 3 of the recording head 1 in a state in which the head 1 is held by the holding portions 8*b*. The rubber seal member 6 is formed of a synthetic rubber that is resistant to ink, and has dimensions assuring that the seal member 6 fully covers the nozzle-opening surface 3.

The rubber seal member 6 includes a recessed portion 6*a* corresponding to an area of the nozzle-opening surface 3 where the nozzles are formed. Therefore, when the rubber seal member 6 is contacted with the nozzle-opening surface 3, a fluid-tight inner space 6*b* (FIG. 4A) is formed between the seal member 6 and the nozzle-opening surface 3.

The main member 8 has two first engaging portions 8*a* that project outward from respective substantially middle portions of two longer-side surfaces of the side portion 8*b* and that can engage the lid member 9. When the lid member 9 is assembled with the main member 8, the two first engaging portions 8*a* are inserted into an inner space of the lid member 9 so as to engage two second engaging portions 9*a* of the lid member 9, respectively.

The lid member 9 is formed by molding of a polyoxymethylene resin, includes a top portion 9*c*, and a side portion 9*d* projecting downward from an outer periphery of the top portion 9*c*, has a generally rectangular shape in its plan view, and opens downward to receive the recording head 1.

The two second engaging portions 9*a* of the lid member 9 are formed in respective substantially middle portions of two longer-side portions of the side wall 9*d*, and engage the two first engaging portions 8*a* of the main member 8, respectively. Each of the second engaging portions 9*a* is formed by making two parallel cuttings in a corresponding one of the two longer-side portions of the side wall 9*b*, and includes a plate-like portion 9*a*1 extending in a direction of extension of the side portion 9*b*, and a hook portion 9*a*2 extending inward from a lower end of the plate-like portion 9*a*1 and having an L-shaped cross section. An inner end surface of the hook portion 9*a*2 is inclined obliquely upward from a lower surface of the same 9*a*2, so as to provide an inclined guide surface for guiding a movement of a corresponding one of the two first engaging portions 8*a*.

When the main member 8 and the lid member 9 are assembled with each other by inserting the main member 8 into the lid member 9, the two first engaging portions 8*a* projecting laterally outward from the main member 8 first engage the respective inclined guide surfaces of the respective hook portions 9*a*2 of the two second engaging portions 9*a*, and then enter the inner space of the lid member 9 while elastically widening a distance between the two plate-like portions 9*a*1. More specifically described, when the two first engaging portions 8*a* enter the inner space of the lid member 9, the two second engaging portions 9*a* of the lid member 9 are pressed by the two first engaging portions 8*a*, respectively, and are elastically deformed in respective outward directions opposite to each other. Once each of the two first engaging portions 8*a* is disengaged from the inclined guide surface of a corresponding one of the two hook portions 9*a*2, the one hook portion 9*a*2 is elastically restored to its original shape, and the two first engaging portions 8*a* are engaged with the two second engaging portions 9*a*, respectively, so that the main member 8 and the lid member 9 are fixed to each other.

In this state, the bottom surface (i.e., the nozzle-opening surface 3) of the recording head 1, held by the sealing case 7, is kept in pressed contact with the bottom portion 8*c* of the main member 8, and the top surface of the head 1 is kept in pressed contact with the top portion 9*c* of the lid member 9. Therefore, the rubber seal member 6 fluid-tightly covers the nozzle-opening surface 3 of the recording head 1, and accordingly fluid-tightly maintains the respective open ends (i.e., the respective ink ejection outlets) of the nozzles. Thus, the inks each as a fluid are fluid-tightly contained by the recording head 1 as a container. In this state, the respective open ends of the nozzles are located in the fluid-tight space 6*b* defined by the recessed portion 6*a* of the rubber seal member 6 and the nozzle-opening surface 3 of the recording head 1. Since the sealing case 7 fluid-tightly holds the recording head 1, the recording head 1 constitutes a fluid-containing container that fluid-tightly contains the inks as fluids, together with air as a gas.

Figure 2A:
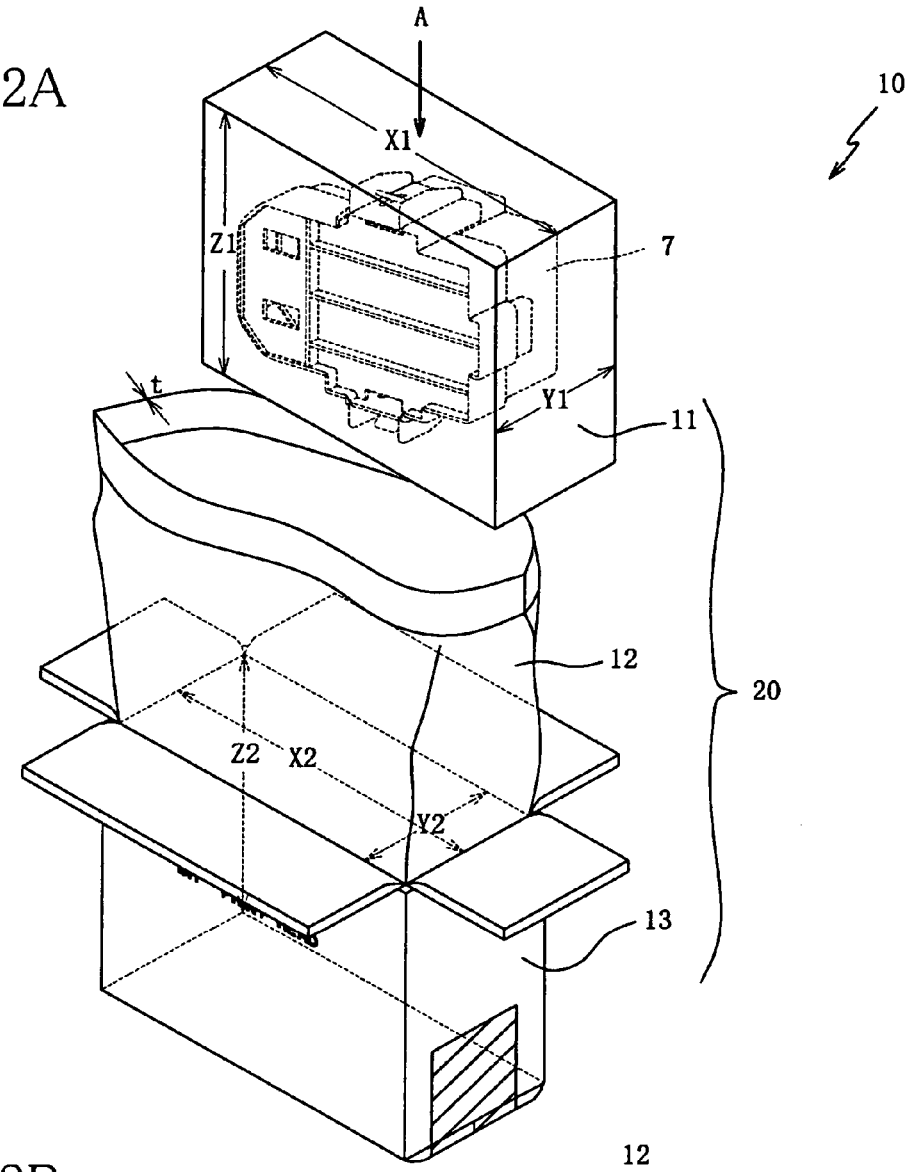
FIG. 2A is a perspective view for explaining the package obtained in the first embodiment.
Figure 2B:
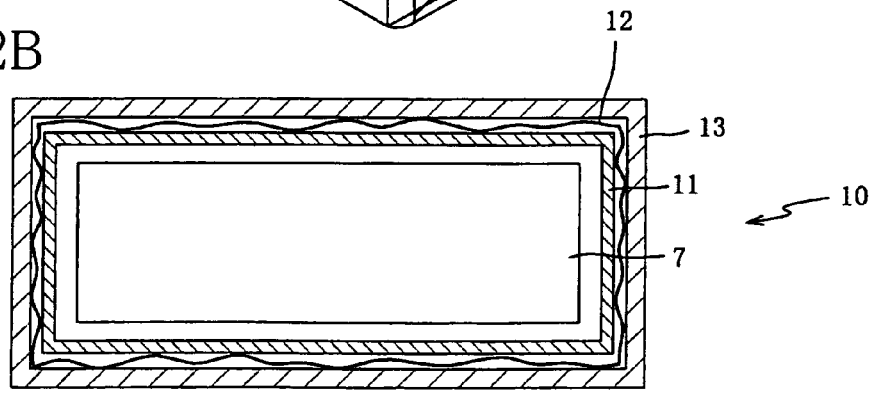
FIG. 2B is a cross-sectional view of the package as viewed in a direction indicated by "A" in FIG. 2A.

FIGS. 2A and 2B show the package 10 obtained by packing, with the packing kit 20, the sealing case 7 that fluid-tightly seals the recording head 1.

As shown in FIGS. 2A and 2B, the packing kit 20 includes a non-gas-tight inner box 11 that accommodates the sealing case 7; a fluid-tight packing bag 12 that fluid-tightly accommodates the inner box 11; and a non-gas-tight outer box 13 that accommodates the packing bag 12. The sealing case 7 is accommodated by the inner box 11, in a state in which the sealing case 7 is wrapped in a polyethylene-based, flexible cushion sheet having, on one major surface thereof, a number of air-filled cells, though not shown.

The outer box 13 is formed of a corrugated cardboard to have a generally rectangular parallelepiped shape, and accommodates, therein, the inner box 11 fluid-tightly sealed by the packing bag 12. The outer box 13 has a generally rectangular bottom portion; four side portions respectively projecting upward from four sides of the bottom portion; and a top portion that can close an upper open end of the box 13 that is defined by respective upper end portions of the four side portions. The top portion is formed by four lid portions that are connected to the respective upper end portions of the four side portions. Each of the four lid portions is pivotable relative to a corresponding one of the four side portions, about a boundary line between the each lid portion and the one side portion. When each lid portion is pivoted inward, the each lid portion partially closes the upper open end of the outer box 13 so as to form a portion of the top portion; and when the each lid portion is pivoted outward, the each lid portion partially opens the upper open end of the outer box 13.

However, the outer box 13 may be formed of any known material other than the corrugated cardboard, so long as that material has a rigidity higher than a rigidity of the packing bag 12, so as to be able to restrain expansion of the packing bag 12 in a low-pressure environment, and is inexpensive. The material may be a thin sheet such as a paperboard or a veneer plate; a fiber-glass reinforced epoxy resin plate; a common resin material such as a polyolefine resin, a polyester resin, a vinyl resin, a polyamide resin or an acrylic resin; or any of those resins each of which contains a filler.

The packing bag 12 is formed of a resin-based flexible sheet that is thermally fusible, and is used for fluid-tightly accommodating the inner box 11 that accommodates the sealing case 7. More specifically described, the packing bag 12 is formed of two rectangular film sheets, such that before the inner box 11 is inserted into the packing bag 12, three sides out of four sides of one of the two rectangular film sheets are fluid-tightly sealed to corresponding three sides of the other film sheet while the respective remaining one sides of the two film sheets are not sealed to each other, so as to form an open end 12*a* (FIG. 3). The open end 12*a* of the packing bag 12 is fluid-tightly closed by thermal fusion (i.e., so-called "heat seal") of the remaining one sides of the two film sheets, in a manner described later.

Figure 3A:
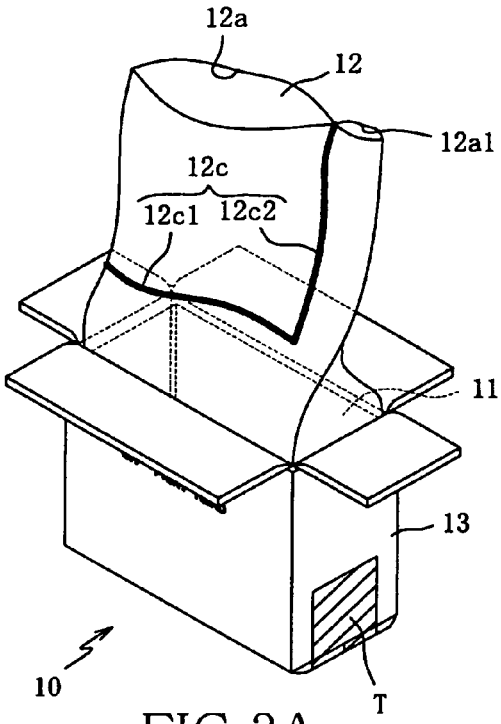
FIGS. 3A, 3B, 3C, and 3D show respective steps of a packing method in which the packing kit, shown in FIG. 2A, is used to pack the sealing case that fluid-tightly seals the recording head.

The packing bag 12 is accommodated by the outer box 13, such that an external shape of the bag 12 is corrected into a corrected shape approximating an internal shape of the outer box 13. In order that the packing bag 12 may be located along (i.e., contacted with, or kept away by only a small distance from) an inner surface of the outer box 13, the bag 12 has an outer surface area that is not smaller than an inner surface area of the outer box 13. In addition, the packing bag 12 has a volume larger than a volume of the inner box 11, and accordingly has an inner space that is not occupied by the inner box 11, inserted in the bag 12. Therefore, the inner box 11 is accommodated by the packing bag 12, such that respective upper portions of the two film sheets that are adjacent to the open end 12*a* are left as a surplus or redundant portion of the bag 12, as shown in FIG. 3A.

A resin-based material used to form the packing bag 12 is selected from a common resin material such as a polyolefine resin, a polyester resin, a vinyl resin, a vinylidene resin, a polyamide resin or an acrylic resin; or a laminated film including (a) a vapor-deposition metal layer or a laminated metal layer and (b) layers formed of any of those resins that cooperate with each other to sandwich the metal layer. In the present embodiment, each of the two film sheets used to form the packing bag 12 has a three-layer structure including an inner and an outer layer each of which is formed of a polyethylene resin having a high water impermeability, and an intermediate layer that is sandwiched by the inner and outer layers and is formed of a copolymer of ethylene and vinyl alcohol, or a nylon resin, that has a low gas permeability. The each film sheet has a thickness of about 80 μm.

If the packing bag 12 has a high gas permeability, then the air present inside of the bag 12 would easily leak to an outside of the same 12, in a low-pressure environment. Thus, the air pressure in the bag 12 would quickly lower. To avoid this, the packing bag 12 is formed of a flexible sheet including an intermediate layer having a low gas permeability.

The inner box 11 for accommodating the sealing case 7 has a rectangular parallelepiped shape, and is formed of cardboard. The inner box 11 is inserted into the packing bag 12, and constitutes a bag correcting device that corrects the external shape of the packing bag 12 into a corrected shape approximating the internal shape (i.e., similitude and size) of the outer box 13. The inner box 11 may have an external shape approximating (preferably, similar to) the internal shape of the outer box 13. In the present embodiment, the inner box 11 has an outer surface opposed to an inner surface of the outer box 13, and has an external shape similar to the internal shape of the outer box 13. Each of the inner and outer boxes 11, 13 is formed to have a rectangular parallelepiped shape, for easier manufacturing purposes. In a state in which the inner box 11 is accommodated by the packing bag 12, the external shape of the bag 12 is defined by the external shape of the inner box 11, and no portions of the bag 12 can enter the inner box 11. Therefore, the external shape of the packing bag 12 can be corrected by the inner box 11 into a corrected shape having a generally rectangular parallelepiped shape corresponding to the external shape of the inner box 11 and accordingly approximating the internal shape of the outer box 13.

Dimensions of the external shape of the inner box 11 are designed as follows: A dimension (i.e., a length), $X_1$, (FIG. 2A) of the inner box 11 in a lengthwise direction thereof, a dimension (i.e., a width), $Y_1$, of the same 11 in a widthwise direction perpendicular to the lengthwise direction, and a dimension (i.e., a height), $Z_1$, of the same 11 in a direction perpendicular to the lengthwise and widthwise directions are smaller than corresponding dimensions, $X_2$, $Y_2$, $Z_2$, of the inner shape of the outer box 13. In addition, in a state in which the inner box 11 is accommodated by the outer box 13, a space is left between the outer surface of the inner box 11 and the corresponding inner surface of the outer box 13, such that the space allows insertion therein of the packing bag 12.

More specifically described, the length $X_1$ of the external shape of the inner box 11 has, as an upper limit thereof, a length, $(X_2-2t)$, obtained by subtracting a thickness, 2t, of the packing bag 12 accommodated by the outer box 13, from the length $X_2$ of the internal shape of the outer box 13, and therefore is not larger than the upper limit. In the present embodiment, the length $X_1$ of the external shape of the inner box 11 is smaller by an amount of from about 0.1 mm to about 3 mm than the length $X_2$ of the internal shape of the outer box 13. Therefore, each of two outer surfaces of the inner box 11 that intersect the lengthwise direction of the same 11 is distant from a corresponding one of two inner surfaces of the outer box 13 by an amount of from about 0.1 mm to about 3 mm, i.e., a small gap or clearance.

In addition, the width $Y_1$ of the external shape of the inner box 11 has, as an upper limit thereof, a length, $(Y_2-2t)$, obtained by subtracting the thickness 2t of the packing bag 12 from the width $Y_2$ of the internal shape of the outer box 13, and therefore is not larger than the upper limit. In the present embodiment, the width $Y_1$ of the external shape of the inner box 11 is smaller by an amount of from about 0.1 mm to about 3 mm than the width $Y_2$ of the internal shape of the outer box 13. Therefore, each of two outer surfaces of the inner box 11 that extend in the lengthwise direction of the same 11 is distant from a corresponding one of two inner surfaces of the outer box 13 by an amount of from about 0.1 mm to about 3 mm, i.e., a small gap or clearance. Thus, in a state in which the inner box 11 accommodated by the packing bag 12 is accommodated by the outer box 13, almost all portions of four side portions of the bag 12 that are respectively opposed to the four side portions of the outer box 13 are contacted with the four side portions, respectively.

In addition, the height $Z_1$ of the external shape of the inner box 11 has, as an upper limit thereof, a length obtained by subtracting, from the height $Z_2$ of the internal shape of the outer box 13, a thickness, t, of a bottom portion of the packing bag 12 that is interposed between the respective bottom portions of the outer and inner boxes 13, 11, and a thickness of a folded-up portion of the bag 12 that is located, and folded up, above the top portion of the inner box 11, and therefore is not larger than the upper limit. In the present embodiment, the height $Z_1$ of the external shape of the inner box 11 is smaller by an amount of from about 0.1 mm to about 3 mm than the height $Z_2$ of the internal shape of the outer box 13. The bottom portion of the inner box 11 is placed on the bottom portion of the outer box 13, with the bottom portion of the packing bag 12 being interposed therebetween. The top portion of the inner box 11 is distant from the top portion of the outer box 13 by an amount of from about 0.1 mm to about 3 mm, and the folded-up portion of the packing bag 12 is packed into the gap left between the respective top portions of the inner and outer boxes 11, 13.

Since the packing bag 12 is internally supported or stretched by the inner box 11 having the external shape approximating the inner shape of the outer box 13, almost all portions of the bag 12 are located at respective positions where those portions are closely contacted with, or are kept closely near to, the inner surface of the outer case 13. That is, the external shape of the packing bag 12 is corrected into a corrected shape approximating the internal shape of the outer box 13. Here, it is noted that the smaller the amount of increasing of the volume of the packing bag 12 is, the smaller the amount of lowering of the inner air pressure of the bag 12 is. In the present embodiment, in order to minimize the change of external shape of the packing bag 12 in the low-pressure environment, the shape of the bag 12 is corrected into the corrected shape approximating the internal shape of the outer box 13, so as to minimize the difference between the external shape of the bag 12 and the internal shape of the outer box 13.

Since the external shape of the bag 12 is corrected by the inner box 11 into the corrected shape approximating the internal shape of the outer box 13, it is not needed to use the bag 12 whose dimensions accurately corresponding to the internal shape of the outer box 13. Therefore, it is not needed to prepare, as the packing bag 12, a special bag that is exclusively used with the inner and outer boxes 11, 13. Rather, it is possible to use, as the packing bag 12, a commercially available bag having standardized dimensions.

In the present embodiment, the respective gaps left between the outer surfaces of the inner box 11 (or the outer surface of the packing bag 12) and the corresponding inner surfaces of the outer box 13, i.e., the distance between each of the outer surfaces of the inner box 11 and a corresponding one of the inner surfaces of the outer box 13 is designed such that even if the packing bag 12 may expand and accordingly the inside air pressure of the bag 12 may lower, the lowering of the air pressure does not cause leakage of the inks from the recording head 1.

The packing kit 20, i.e. the inner box 11, the intermediate packing bag 12, and the outer box 13 are used in the above-described manner to pack the sealing case 7 that fluid-tightly seals the recording head 1, and thereby obtain the package 10. The packages 10 each of which contains the recording head 1 packed with the packing kit 20 are shipped from a factory and are supplied to a market. In the case where the packages 10 are transported as air freight, the recording heads 1 are subjected to the low-pressure environment whose atmospheric pressure is lower than a normal atmospheric pressure in which the recording heads 1 are packed with the packing kits 20. Hereinafter, there will be described a condition of the package 10 in the low-pressure environment, by reference to FIGS. 4A, 4B, 4C, and 4D.

Figure 4A:
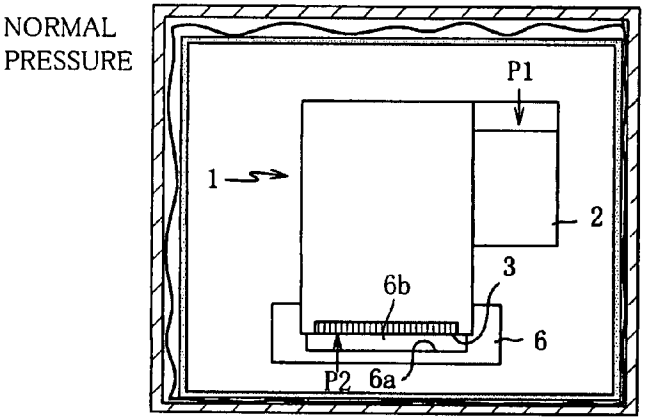
FIG. 4A shows a condition of the package, shown in FIG. 3D, in a normal-pressure environment.
Figure 4B:
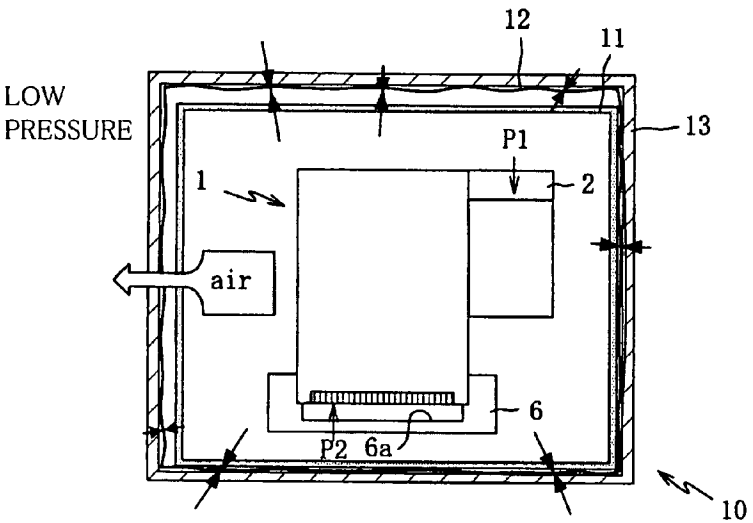
FIG. 4B shows a condition of the package in a low-pressure environment.
Figure 4C:
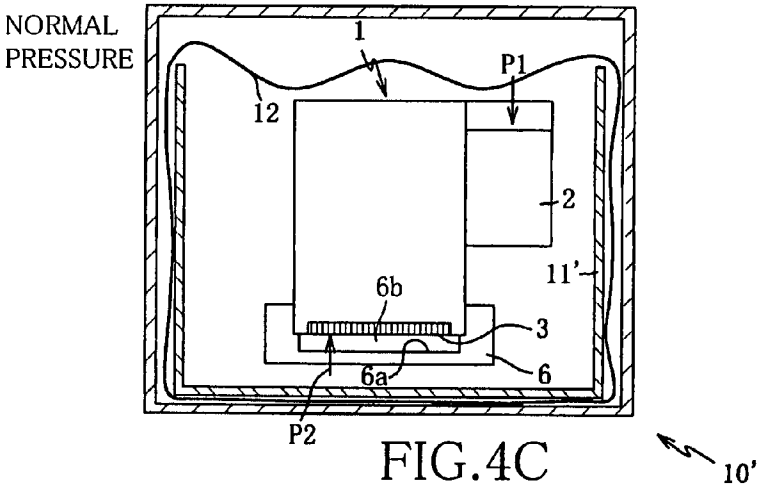
FIG. 4C shows a condition of a comparative package in the normal-pressure environment.
Figure 4D:
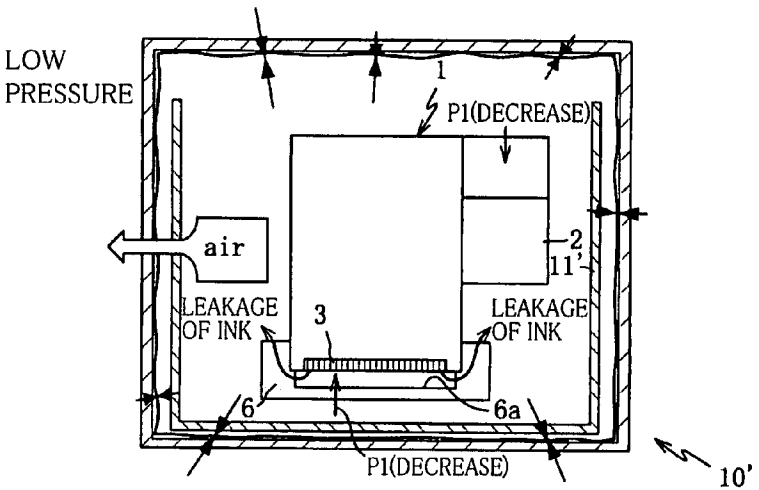
FIG. 4D shows a condition of the comparative package in the low-pressure environment.

FIGS. 4A, 4B, 4C, and 4D illustrate various conditions of the package 10. More specifically explained, FIGS. 4A and 4B show a condition of the package 10 in a normal-pressure environment, and a condition of the package 10 in a low-pressure environment, respectively; and FIGS. 4C and 4D show respective comparative examples. In each of FIGS. 4A through 4D, for easier understanding purposes only, the sealing case 7 is represented by the rubber seal member 6 only, and the remaining portions of the same 7 are omitted. In the present embodiment, the normal-pressure environment has about 1 atm (atmosphere); and the low-pressure environment has about 0.7 atm, i.e., an average atmospheric pressure at which the packages 10 are conveyed by air transportation.

As described above, FIG. 4A shows the condition of the package 10 in the normal-pressure environment. The recording head 1 fluid-tightly containing the inks is first accommodated by the inner box 11, then is fluid-tightly accommodated by the packing bag 12, and finally is accommodated by the outer box 13. In the normal-pressure environment, an atmospheric pressure having about 1 atm is present inside, and outside, of the package 10, and inside, and outside, of the packing bag 12.

The rubber seal member 6 of the sealing case 7 is pressed, with a pre-selected pressing force, against the nozzle-opening surface 3 of the recording head 1. The pre-selected pressing force is defined by a construction of an engaging device (i.e., the first and second engaging portions 8*a*, 9*a*) operable to cause the main member 8 and the lid member 9 to engage each other, such that an amount of retraction of the nozzle-opening surface 3 being pressed, from a normal position (i.e., a designed position) falls within a permissible range corresponding to an ink ejection performance of the recording head 1.

Meanwhile, each of the four ink chambers 2*a*, 2*b*, 2*c*, 2*d* of the ink tank 2 of the recording head 1 has the air layer above a corresponding one of the four sorts of inks, in the normal-pressure environment. A pressure, $P_1$, of the air layer acting on the ink present in the each ink chamber 2*a* through 2*d* is about 1 atm in the normal-pressure environment. Also, a pressure, $P_2$, of the air present in the inner space 6*b* of the rubber seal member 6 is about 1 atm in the normal-pressure environment. The inner space 6*b* is defined by the recessed portion 6*a* of the seal member 6 and the nozzle-opening surface 3 in the state in which the seal member 6 is held in pressed contact with the nozzle-opening surface 3. Thus, the pressure $P_1$ and the pressure $P_2$ are balanced with each other, and accordingly a meniscus of ink is formed in the ink ejection outlet of each of the nozzles of the recording head 1. Therefore, the inks present in the ink chambers 2*a* through 2*d* do no leak into the inner space 6*b* of the seal member 6, or from the inside, to the outside, of the seal member 6.

FIG. 4C shows a condition of a comparative package 10' in a normal-pressure environment. A recording head 1 containing inks is placed in an inner box 11' whose dimensions largely differ from those of an outer box 13, such that the recording head 1 and the inner box 11' are fluid-tightly accommodated by a packing bag 12, which in turn is accommodated by the outer box 13. Thus, the comparative package 10' does not include a bag correcting device, such as an inner box 11 shown in FIG. 2A, that corrects an external shape of the bag 12 into a corrected shape approximating an internal shape of the outer box 13. In this case, the package 10' is obtained by using a packing kit consisting of the inner box 11', the packing bag 12, and the outer box 13.

In the comparative package 10', a rubber seal member 6 is pressed, with a pre-selected pressing force, against a nozzle-opening surface 3 of the recording head 1, and is fluid-tightly contacted with the same 3. In a normal-pressure environment, a pressure P1 of an air present in an ink tank 2 and a pressure P2 of an air present in an inner space 6*b* of the seal member 6 are balanced with each other, and accordingly no ink leaks from the recording head 1.

FIG. 4B shows a condition of the package 10 in a low-pressure environment. Like the recording head 1 of the package 10, shown in FIG. 4A, the recording head 1 of the package 10, shown in FIG. 4B, contains inks, is accommodated by the inner box 11, is fluid-tightly accommodated by the packing bag 12, and is accommodated by the outer box 13. When the package 10 is brought into the low-pressure environment, a pressure difference is produced between the inside and outside of the packing bag 12, so that the bag 12 expands. As the packing bag 12 expands, the inside air pressure of the bag 12 lowers in inverse proportion with the increased inner volume of the same 12.

However, in the package 10 as the first embodiment of the present invention, the inner box 11 is placed in the packing bag 12, and is positioned relative to the outer box 13 such that only small gaps are left between the outer surfaces of the inner box 11 and the corresponding inner surfaces of the outer box 13. That is, the external shape (i.e., similitude and size) of the packing bag 12 is corrected to approximate the internal shape of the outer box 13. Therefore, only if the packing bag 12 slightly inflates, then the bag 12 contacts the outer box 13, so that the inflation of the bag 12 is restrained by the outer box 13. Thus, in the low-pressure environment, an amount of inflation of the packing bag 12 can be minimized.

In the present embodiment, the gap left between the upper surface of the inner box 11 and the top portion of the outer box 13 is larger than each of the respective gaps left between the four side surfaces of the inner box 11 and the four side portions of the outer box 13. However, the larger gap is filled with the folded-up, upper portion of the bag 12. Therefore, only if the packing bag 12 slightly inflates, then the bag 12 indirectly contacts the outer box 13 via the folded-up portion, so that the inflation of the bag 12 is effectively restrained by the outer box 13.

Thus, the lowering of the inside air pressure of the packing bag 12 is minimized, and only a small pressure difference is produced between the inside air pressure of the bag 12 and the air pressure P2 of the inner space 6*b* of the rubber seal member 6. Therefore, substantially no air leaks from the inner space 6*b* of the seal member 6 into the outside of the same 6. That is, the meniscus of ink in the ink ejection outlet of each nozzle, formed in the normal-pressure environment, and the balancing of the pressure P1 and the pressure P2 can be maintained even in the low-pressure environment. Therefore, no inks leak from the respective ink ejection outlets of the nozzles that are sealed by the rubber seal member 6.

FIG. 4D shows a condition of the comparative package 10' in the low-pressure environment. As compared with the package 10 as the first embodiment of the present invention, the comparative package 10' suffers a problem that an amount of inflation of the packing bag 12 is large and accordingly an air pressure in the bag 12 largely lowers. Consequently a large pressure difference is produced between the inside air pressure of the bag 12 and the air pressure P2 in the inner space 6*b* of the rubber seal member 6. Thus, a portion of the seal member 6 that is adapted to contact the nozzle-opening surface 3 is deformed outward, so that the air may leak from the inner space 6*b* into the outside of the seal member 6. In addition, the air pressure P2 in the inner space 6*b* of the seal member 6 is made lower than the air pressure P1 in the ink tank 2, so that the inks may leak from the ink tank 2 into the inner space 6*b*. In a particular case where the pressure difference between the inside and outside of the rubber seal member 6 is significantly large, the inks further leak from the inner space 6*b* into the outside of the seal member 6.

Since the packing bag 12 has a certain degree of gas permeability, the air in the bag 12 leaks, little by little, into the outside thereof, in the low-pressure environment. However, in the present embodiment, the inner box 11 is used as the bag correcting device that corrects the external shape of the bag 12. Since the inner box 11 has an inner space, the packing bag 12 can contain a large amount of air in the inner box 11. Thus, a ratio of an amount of air leaking from the packing bag 12 to an amount of air remaining in the bag 12 can be made low, and accordingly a rate of lowering of the air pressure in the bag 12 can be made low. Since a laminated film including a vapor-deposition or laminated metal layer and resin layers that sandwich the metal layer has a low gas permeability, i.e., a high gas impermeability, the bag 12 may be formed of the laminated film so as to prevent the lowering of inside air pressure of the bag 12 because of its gas permeability.

Next, there will be described a method of packing, with the packing kit 20, the sealing case 7, by reference to FIGS. 3A, 3B, 3C, and 3D. This method is one embodiment according to the present invention.

First, the sealing case 7 fluid-tightly sealing the recording head 1 is accommodated by the non-gas-tight inner box 11. Second, the inner box 11 is inserted into the fluid-tight packing bag 12 through the open end 12*a* thereof. This is a container inserting step. Then, in a state in which the open end 12*a* of the packing bag 12 remains open, the bag 12 is placed in the non-gas-tight outer box 13 in a direction from an upper, open end thereof toward a bottom portion thereof, so that the inner box 11 is contacted with the outer box 13 via a portion of the bag 12. This is a bag placing step. An adhesive tape T including a substrate formed of a polyester resin (e.g., a polyethylene terephthalate) is adhered to an outer surface of the bottom portion of the outer box 13, and respective outer surfaces of two side portions adjacent to lengthwise opposite ends of the bottom portion. Thus, a rigidity of the outer box 13 is reinforced by the adhesive tape T.

When the packing bag 12 is inserted into the outer box 13, the bag 12 is slid on the inner surfaces of the outer box 13, while being sandwiched by the inner and outer boxes 11, 13. Thus, a large amount of air is squeezed and discharged out of the gaps left between the inner box 11 and the bag 12 into the outside of the bag 12 via the open end 12*a* thereof. After the insertion of the packing bag 12, the bag 12, i.e., the two film sheets whose three sides have been sealed are subjected to heat seal, i.e., thermal fusion, so as to close an almost entire portion of the open end 12*a* and form a narrow air-discharge passage 12*b* having an air-discharge outlet 12*a*1. This is a passage-forming and open-end-closing step.

The air-discharge outlet 12*a*1 is formed by subjecting the packing bag 12 to thermal fusion and thereby forming an L-shaped seal 12*c*. More specifically described, the L-shaped seal 12*c* includes a first seal portion 12*c*1 that extends linearly in a widthwise direction of the bag 12, i.e., a lengthwise direction of the inner box 11, and has a pre-selected width. The first seal portion 12*c*1 is formed at a position above the inner box 11 and near to the top portion thereof. A length of the first seal portion 12*c*1 is pre-selected to be shorter than the width of the packing bag 12, and accordingly the first seal portion 12*c*1 has one end at a widthwise intermediate position of the bag 12. Thus, the packing bag 12 has, in the widthwise direction thereof, a portion that is not subjected to thermal fusion and allows the bag 12 to open outward. The L-shaped seal 12*c* additionally includes a second seal portion 12*c*2 that starts with the above-indicated one end of the first seal portion 12*c*1, extends linearly in a direction perpendicular to the widthwise direction of the bag 12, and ends with the open end 12*a* of the bag 12. Thus, the bag 12 is sealed by the L-shaped seal 12*c*, such that the bag 12 has the air-discharge passage 12*b* starting with the one end of the first seal portion 12*c*1, ending with the open end 12*a*, and having the air-discharge outlet 12*a*1. Thus, an almost entire portion of the open end 12*a* of the packing bag 12 is fluid-tightly closed, while the inside of the bag 12 is kept communicated with the outside thereof via the air-discharge passage 12*b*, as shown in FIG. 3A.

Figure 3B:
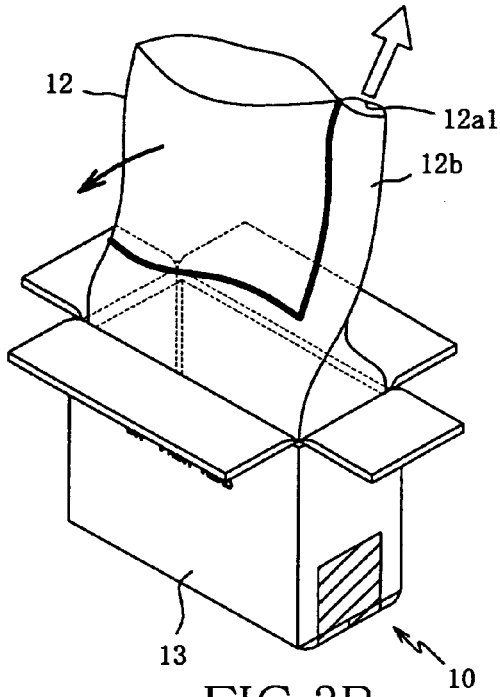
Figure 3C:
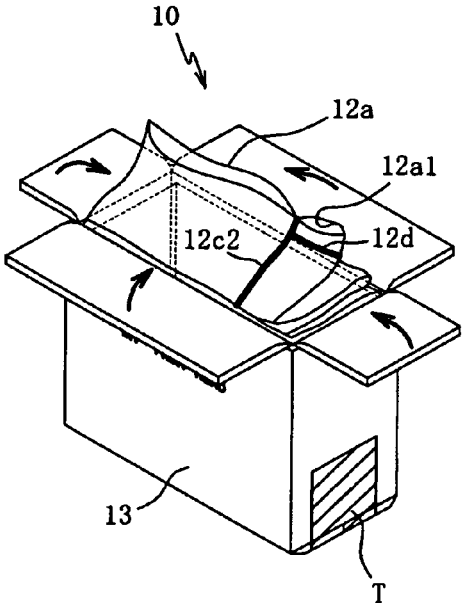
Figure 3D:
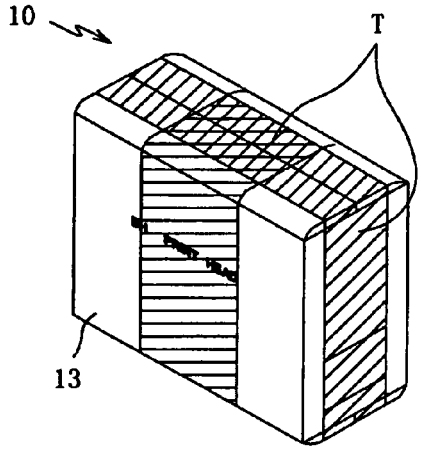

Next, an excessive or surplus portion of the packing bag 12 that is present above the inner box 11 is folded up such that the air-discharge outlet 12*a*1 is exposed to the outside, while air is discharged from the bag 12 through the air-discharge passage 12*b*, as shown in FIG. 3B. This is a folding-up step. Subsequently, in the vicinity of an upper, open end of the air-discharge outlet 12*a*1, the outlet 12*a*1 is subjected to thermal fusion, so that a closing seal 12*d* is formed from one of widthwise opposite ends of the outlet 12*a*1 to the other end thereof. Thus, the air-discharge outlet 12*a*1 is completely shut off, and the packing bag 12 is fluid-tightly closed. After the closing of the packing bag 12, the four lid portions of the outer box 13 that are now kept to their open positions are folded inward to close the upper open end of the outer box 13, as shown in FIG. 3C. This is a fluid-tightly closing step. Then, the adhesive tape T is adhered to the outer box 13, from one of lengthwise opposite side portions of the box 13 to the other side portion thereof via the top portion thereof, so as to prevent opening of the top portion thereof. The sealing case 7 holding the recording head 1 is packed in the steps that are sequentially carried out in the above-described order, so that the package 10 including the sealing case 7 or the recording head 1 is finally obtained.

As described above, the external shape of the inner box 11 approximates the internal shape of the outer box 13, and the distance between each of the outer surfaces of the inner box 11 and a corresponding one of the inner surfaces of the outer box 13 is small. Meanwhile, the packing bag 12 can easily accommodate the inner box 11 because the inner volume of the bag 12 is sufficiently larger than that of the inner box 11 or the outer box 13. Therefore, if the packing bag 12 is fluid-tightly closed before the bag 12 is placed in the outer box 13, then the air present in the bag 12 may not be fully accommodated by the gaps left between the inner and outer boxes 11, 13, i.e., the bag 12 may not be completely accommodated by the outer box 13. In contrast, in the present embodiment, the packing bag 12 is fluid-tightly closed after the bag 12 is placed in the outer box 13, and accordingly the bag 12 can be reliably accommodated by the outer box 13. In addition, since the final closure seal 12*d* is formed by thermal fusion after the upper, surplus portion of the packing bag 12 is folded up while the air is discharged from the bag 12 via the air-discharge outlet 12*a*1, the bag 12 can be fluid-tightly closed after the surplus portion of the bag 12 has been assuredly accommodated by the space present between the inner and outer boxes 11, 13. Thus, the present packing method is freed of the problem that the packing bag 12 cannot be accommodated by the outer box 13 because the surplus portion of the bag 12 cannot be accommodated by the space left between the inner and outer boxes 11, 13.

However, the above-described bag placing step in which the packing bag 12 is placed in the outer box 13 may be carried out before the bag 12 is accommodated by the outer box 11, or after the above-described, passage-forming and open-end-closing step.

Figure 5A:
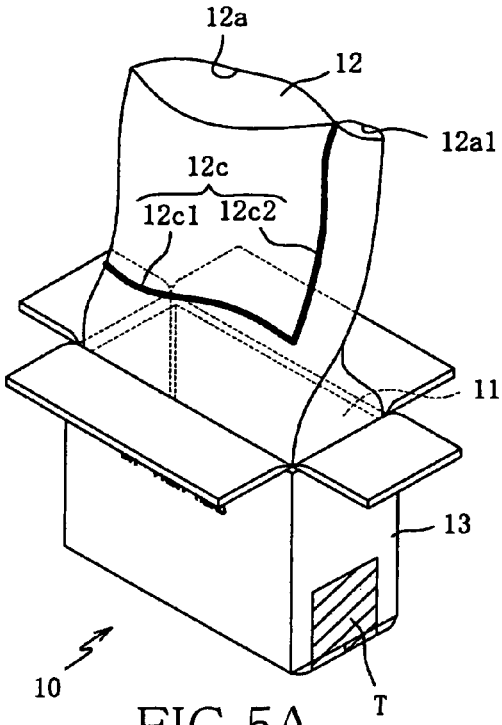
FIGS. 5A, 5B, 5C, and 5D show respective steps of a modified packing method in which a modified packing kit is used to pack the sealing case that fluid-tightly seals the recording head.
Figure 5B:
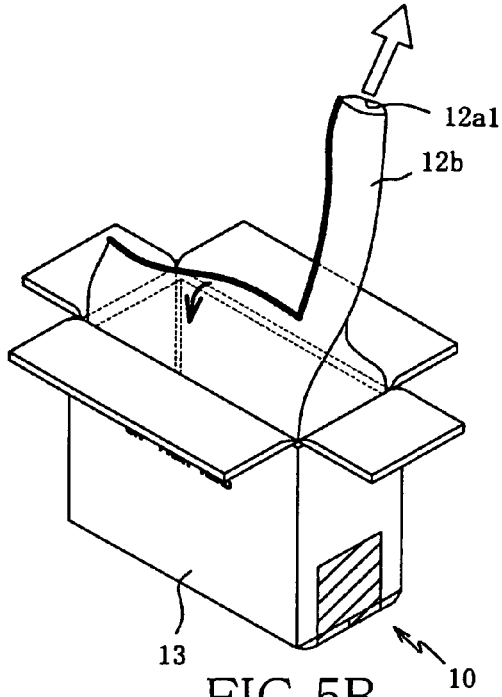
Figure 5C:
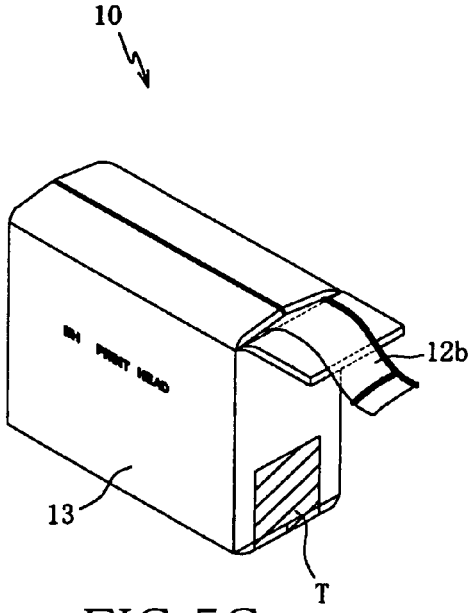
Figure 5D:
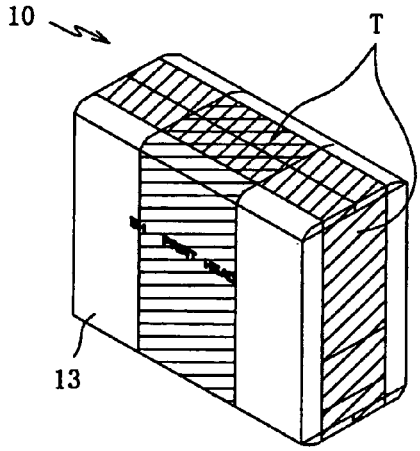

FIGS. 5A, 5B, 5C, and 5D show a modified form of the first embodiment shown in FIGS. 3A through 3D. In this modified form, after the above-described, passage-forming and open-end-closing step, shown in FIG. 5A, a portion of the packing bag 12 that is surrounded by the first and second seal portions 12*c*1, 12*c*2 is removed as shown in FIG. 5B, and then the above-described folding-up step is carried out. In addition, the fluid-tightly closing step is modified, as shown in FIG. 5C, such that in a state in which the air-discharge passage 12*b* is drawn out of the outer box 13, three lid portions of the outer box 13 that include two longer lid portions are folded inward to form a top portion of the outer box 13 and thereby close the upper open end thereof, then the air-discharge passage 12*b* is placed on the top portion of the outer box 13, and the remaining one lid portion is folded inward, as shown in FIG. 5D. In this modified form, therefore, the portion of the packing bag 12 that is surrounded by the first and second seal portions 12*c*1, 12*c*2 is removed and accordingly need not be accommodated by the outer box 13. Thus, the present modified packing method is more reliably freed of the problem that the packing bag 12 may not be accommodated by the outer box 13.

Figure 6:
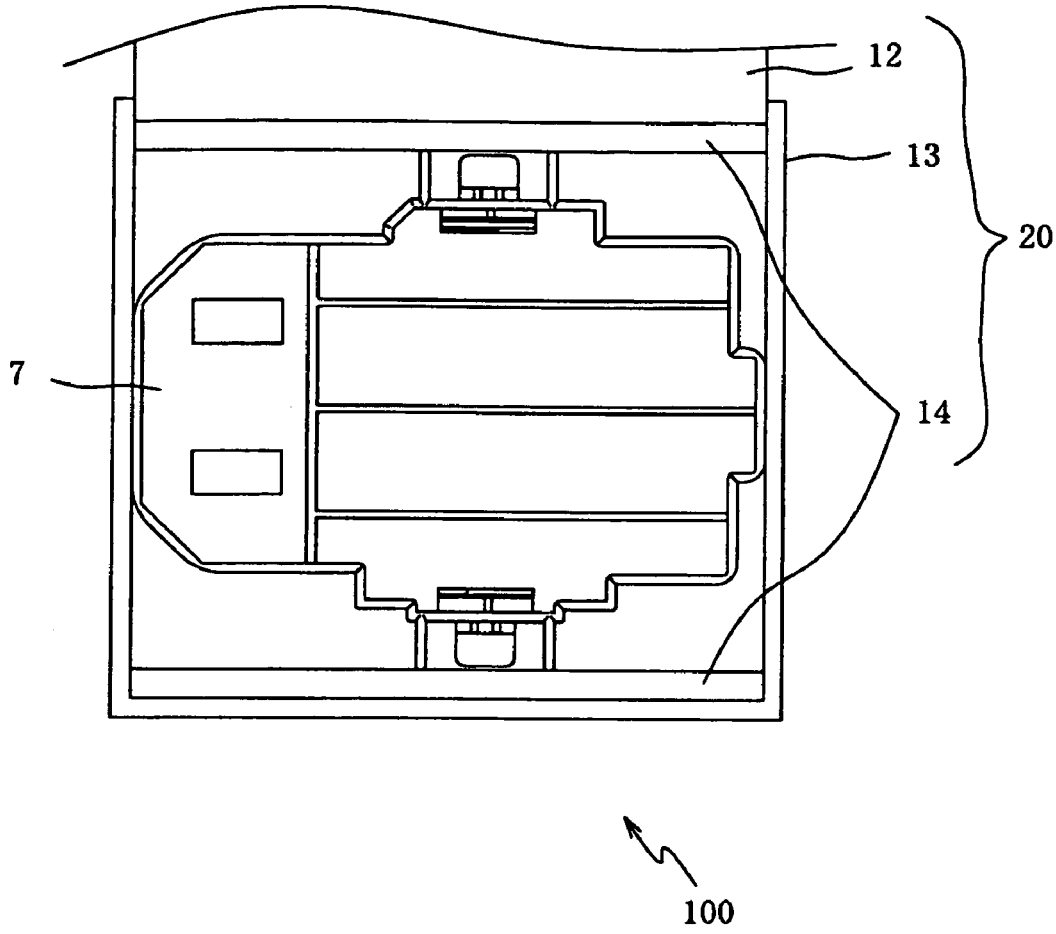
FIG. 6 is a front elevation view of an internal construction of another package obtained in a second embodiment of the present invention.

Next, there will be described a second embodiment of the present invention by reference to FIG. 6. FIG. 6 illustratively shows an internal construction of a package 100 as the second embodiment. The same reference numerals as used in the first embodiment, shown in FIGS. 1, 2A, 2B, 3A through 3D, and 4A through 4D, are used to designate the corresponding elements of the second embodiment, and the description thereof is omitted.

The package 100 includes the sealing case 7 fluid-tightly sealing the recording head 1, and a different packing kit 20 that packs the sealing case 7. In the second embodiment, the packing kit 20 includes, in addition to a packing bag 12 and an outer case 13, two flat members 14 in place of the inner box 11. The two flat members 14 cooperate with each other to provide a bag correcting device that corrects the external shape of the packing bag 12.

The two flat members 14 are opposed to the top and bottom portions of the outer box 13, respectively, and have respective shapes approximating the respective inner surfaces of the top and bottom portions. More specifically described, each of the two flat members 14 has a rectangular shape, and a length $X_1$ of the each flat member 14 has, as an upper limit thereof, a length, $(X_2-2t)$, obtained by subtracting a thickness, 2t, of the packing bag 12 accommodated by the outer box 13, from a length $X_2$ of the internal shape of the outer box 13, and therefore is not larger than the upper limit. In addition, a width $Y_1$ of the each flat member 14 has, as an upper limit thereof, a width, $(Y_2-2t)$, obtained by subtracting a thickness, 2t, of the packing bag 12 accommodated by the outer box 13, from a width $Y_2$ of the internal shape of the outer box 13, and therefore is not larger than the upper limit.

One of the two flat members 14 is placed in the outer box 13, such that the one flat member 14 is contacted, via a portion of the packing bag 12, with the inner surface of the bottom portion of the outer box 13. The sealing case 7 is placed on the one flat member 14, and the other flat member 14 is placed on the sealing case 7. Thus, the two flat members 14 and the sealing case 7 are accommodated by the packing bag 12. The other, i.e., upper flat member 14 is kept distant, in a downward direction, from the top portion of the outer box 13, and an upper, surplus portion of the packing bag 12 is accommodated by a space left between the upper flat member 14 and the top portion of the outer box 13.

Each of the two flat members 14 has a simple shape and accordingly can be easily manufactured. That is, the bag correcting device can be easily produced, which leads to reducing the production cost of the packing kit 20.

In this embodiment, the two flat members 14 are opposed to the top and bottom portions of the outer box 13, respectively. However, the two flat members 14 may be used in such a manner that the two flat members 14 are opposed to any pair of opposite portions of the outer box 13, respectively. In addition, the two flat members 14 may be replaced by four flat members 14 that are opposed to two pairs of opposite portions of the outer box 13 that cooperate with each other to surround the sealing case 7.

The flat members 14 as the bag correcting device need to correct the external shape of the packing bag 12 into a substantially rectangular-parallelepiped shape approximating the internal shape of the outer box 13. To this end, the bag correcting device needs to support eight vertices of the rectangular-parallelepiped shape. Therefore, the bag correcting device needs to be provided along respective outer peripheries of two opposite portions of the outer box 13 that are selected from the top, side, and bottom portions of the same 13. More specifically described, the bag correcting device employs correcting members that are provided along at least one pair of opposite sides of each of the two opposite portions of the outer box 13. Those correcting members may be either the two flat, solid members 14, or two hollow frame members each of which has the same external shape as that of each flat member 14 and has a central opening formed through a thickness of its own. Alternatively, those correcting members may be four columnar members that are provided along four corners of the rectangular-parallelepiped shape, respectively.

After the packing kit 20 is opened to take out the sealing case 7 or the recording head 1, the packing kit 20 is not used any longer. Hence, the kit 20 is discarded or recycled. Since, however, the bag correcting device is constituted by the two flat members 14, the two frame members, or the four columnar members, the bag correcting device can be easily dealt with, which leads to reducing a load applied to a person who discards or recycles the device.

The correcting members such as the flat members 14, the frame members, or the columnar members may be formed of a known material, such as resin, metal, ceramics, or paper. Alternatively, the correcting members may be formed of a porous material having a multiplicity of pores therein.

Figure 7:
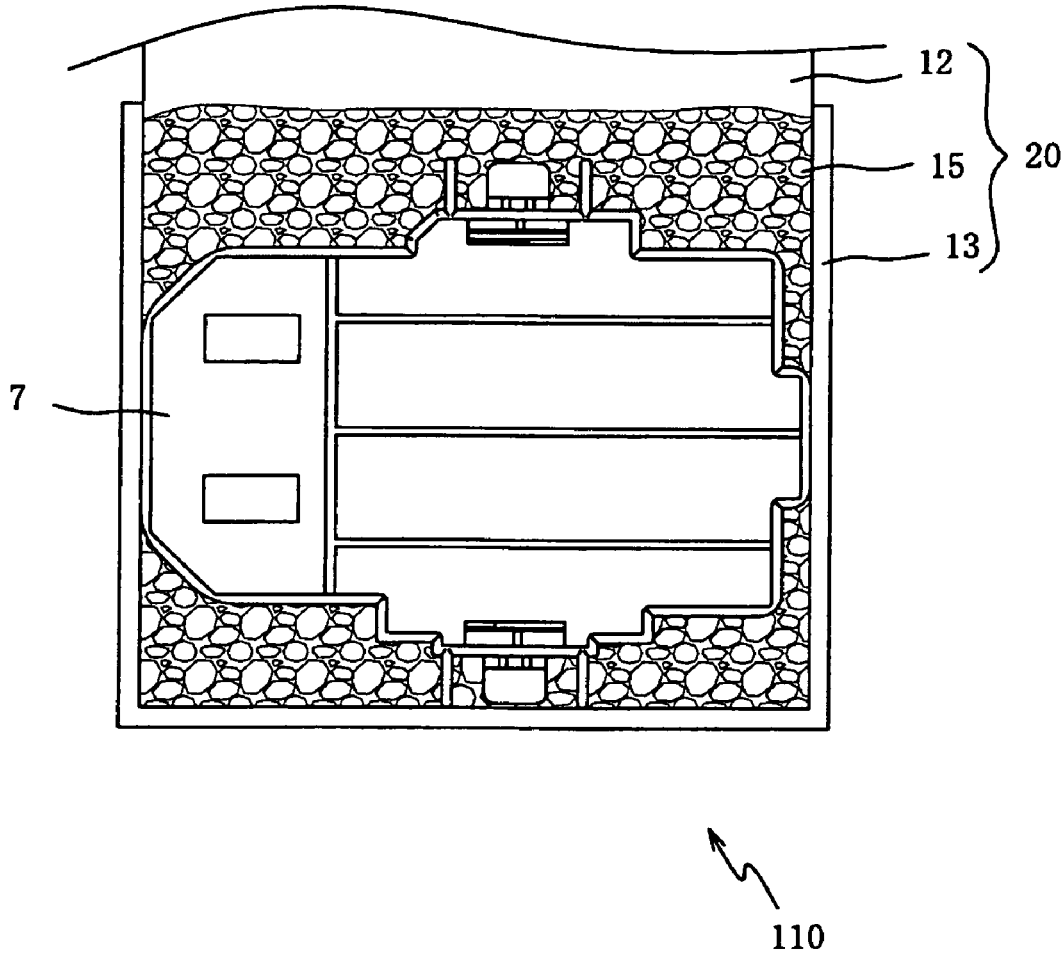
FIG. 7 is a front elevation view of an internal construction of another package obtained in a third embodiment of the present invention.

Next, there will be described a third embodiment of the present invention by reference to FIG. 7. FIG. 7 illustratively shows an internal construction of a package 110 as the third embodiment. The same reference numerals as used in the first embodiment are used to designate the corresponding elements of the third embodiment, and the description thereof is omitted.

The package 110 includes the sealing case 7 holding the recording head 1, and a different packing kit 20 that packs the sealing case 7. In the third embodiment, the packing kit 20 includes, in addition to a packing bag 12 and an outer case 13, hard-urethane-foam balls or pellets 15 in place of the inner box 11. The urethane-foam pellets 15 constitute a bag correcting device that corrects the external shape of the packing bag 12. Since the urethane-foam pellets 15 are formed of a porous material, the pellets 15 contain or trap a large amount of air. Therefore, even if a large amount of urethane-foam pellets 15 may be charged into the packing bag 12, a large amount of gas (i.e., air) is trapped in the bag 12. Thus, even if the packing bag 12 may be formed of a material having a gas permeability, the rate of lowering of the air pressure in the bag 12 in the low-pressure environment can be minimized.

Each of the urethane-foam pellets 15 has a massive structure that does not have a defined shape, and is so formed as to be able to enter gaps corresponding to the difference between the respective shapes of the sealing case 7 and the outer box 13. Since the urethane-foam pellets 15 as a whole can be said to have a certain degree of "fluidity", the pellets 15 flow or move in the packing bag 12, and fill up the gaps left between the sealing case 7 and the outer box 13. Consequently the packing bag 12 is expanded outward by the pellets 15 so as to have a corrected shape approximating the internal shape of the outer box 13. Therefore, even in the case where the sealing case 7 has a complicated external shape and a large difference is present between the external shape of the sealing case 7 and the internal shape of the outer box 13, the urethane-foam pellets 15 can correct the external shape of the packing bag 12 so as to compensate for the large shape difference.

The urethane-foam pellets 15 as a filling material may be replaced by a different filling material such as pellets formed of an appropriate resin, e.g., soft urethane foam or polystyrene foam, or chips of an appropriate material, e.g., paper, pulp, or wood.

Figure 8:
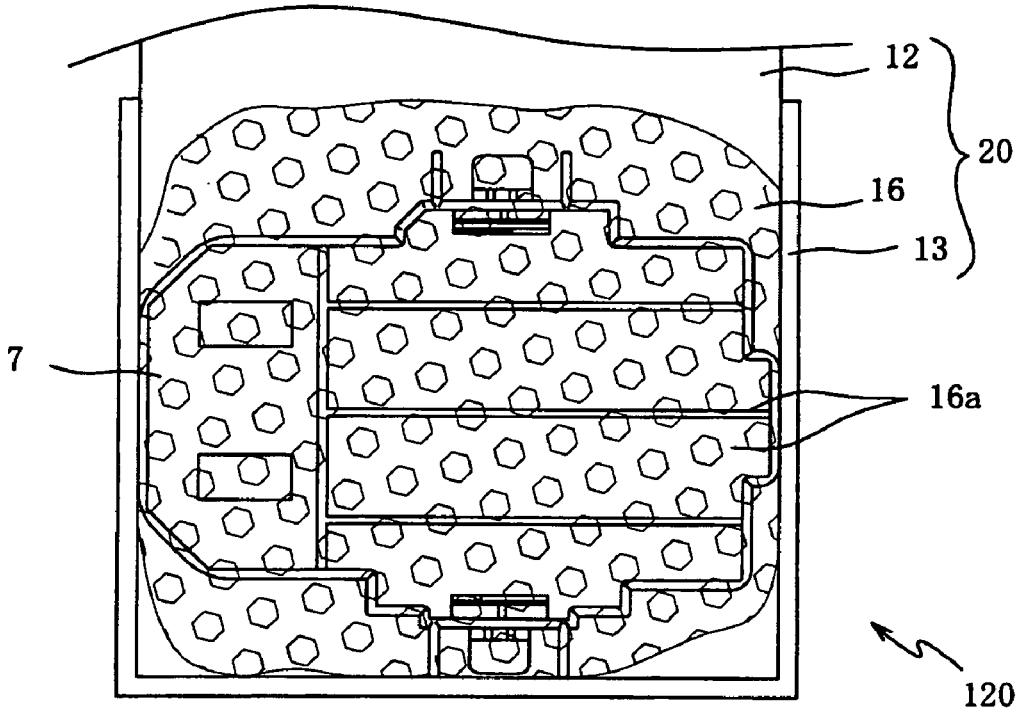
FIG. 8 is a front elevation view of an internal construction of another package obtained in a fourth embodiment of the present invention.

Next, there will be described a fourth embodiment of the present invention by reference to FIG. 8. FIG. 8 illustratively shows an internal construction of a package 120 as the fourth embodiment. The same reference numerals as used in the first embodiment are used to designate the corresponding elements of the fourth embodiment, and the description thereof is omitted.

The package 120 includes the sealing case 7 carrying the recording head 1, and a different packing kit 20 that packs the sealing case 7. In the fourth embodiment, the packing kit 20 includes, in addition to a packing bag 12 and an outer case 13, a flexible wrapping sheet 16 in place of the inner box 11. The flexible wrapping sheet 16 constitutes a bag correcting device that corrects the external shape of the packing bag 12. The flexible wrapping sheet 16 has a number of air-filled cells 16*a* each of which is filled with air and projects from one of opposite major surfaces thereof.

The sealing case 7 is wrapped in the wrapping sheet 16, and then is fluid-tightly accommodated by the packing bag 12. Since the wrapping sheet 16 is flexible, one or more specific portions of the sheet 16 can be folded up to have an increased number of layers and thereby change its thickness. For example, a portion of the wrapping sheet 16 may be folded a first number of times whereas another portion of the wrapping sheet 16 may be folded a second number of times that is different from the first number. In this case, a portion of the sealing case 7 may be wrapped in the "thick" portion of the wrapping sheet 16 whereas another portion of the sealing case 7 may be wrapped in the "thin" portion of the sheet 16. Thus, the wrapping sheet 16 can correct a difference between the external shape of the sealing case 7 and the internal shape of the outer box 13. That is, the wrapping sheet 16 can correct the external shape of the packing bag 12 accommodating the sealing case 7, into a corrected shape approximating the internal shape of the outer box 13.

The wrapping sheet 16 can correct the external shape of the packing bag 12 into different shapes corresponding to respective shapes of various sorts of outer boxes 13, since the sheet 16 can be folded in different manners. Thus, the wrapping sheet 16 as the bag correcting device enjoys a high degree of freedom. Therefore, a wrapping sheet 16 according to one standard can be used, without modifying the standard, to correct the shape of the packing bag 12 into different shapes corresponding to respective shapes of various sorts of outer boxes 13. That is, the wrapping sheet 16 can find broader applications. In addition, as compared with the urethane-foam pellets 15 employed in the third embodiment, the wrapping sheet 16 has a larger size and accordingly can be more easily dealt with. After the packing kit 20 is opened, the kit 20 needs to be discarded or recycled. Since, however, the wrapping sheet 16 does not scatter unlike the urethane-foam pellets 20, the sheet 16 can be easily treated. That is, the recording head 1 can be taken out of the package 120 with high efficiency.

Figure 9:
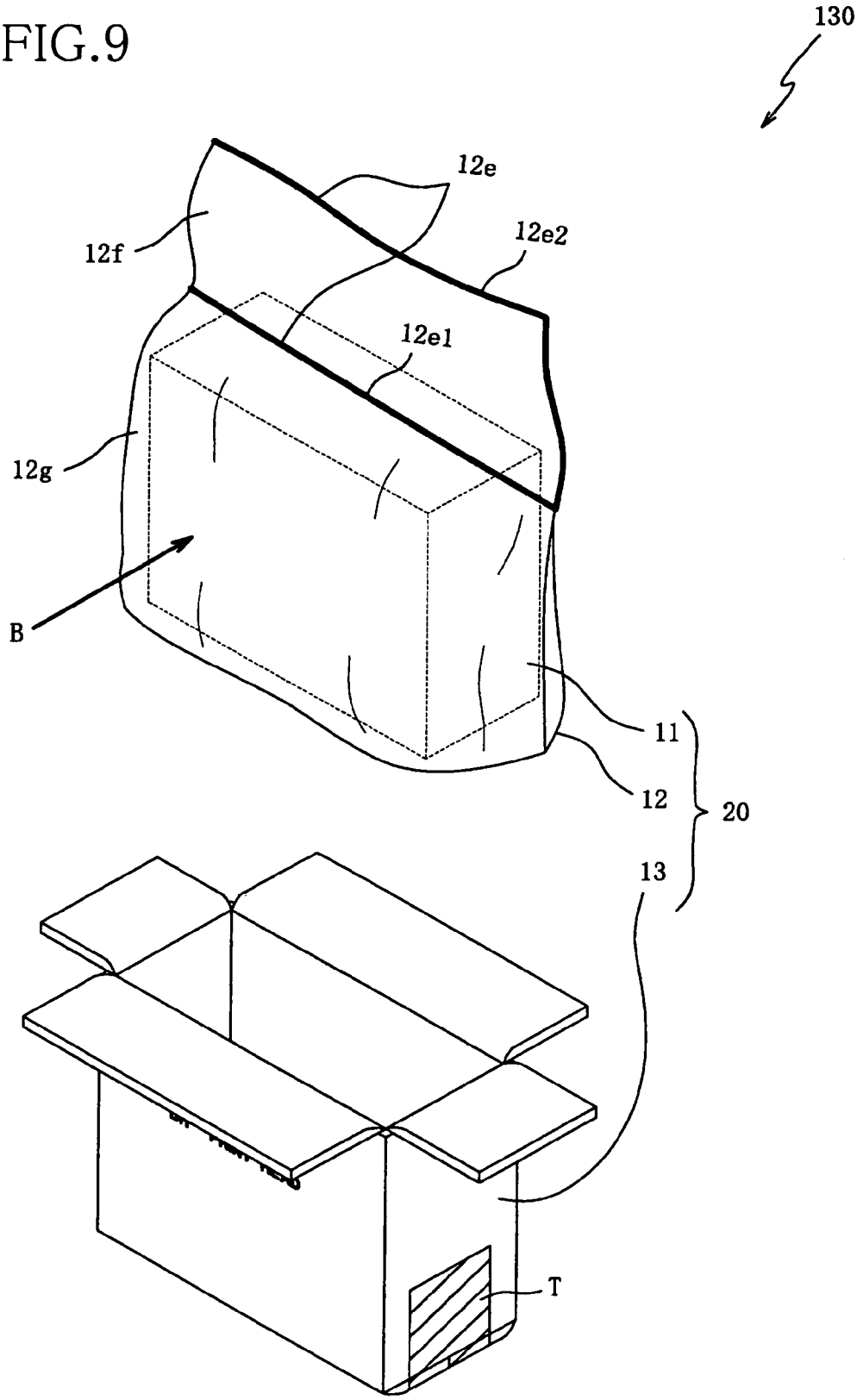
FIG. 9 is a perspective view of a construction of another package obtained in a fifth embodiment of the present invention.
Figure 10B:
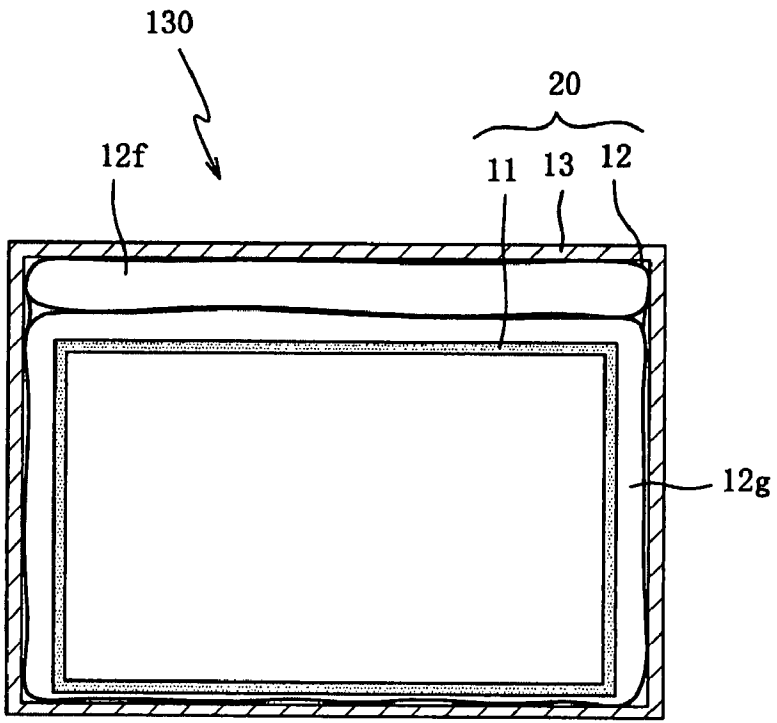
FIG. 10B is a cross-sectional view of the package in the low-pressure environment.
Figure 10A:
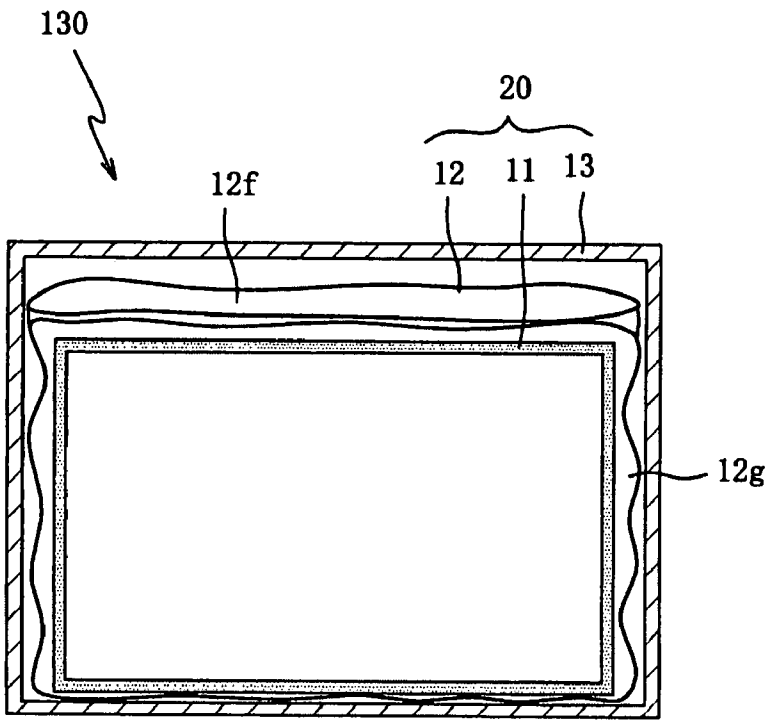
FIG. 10A is a cross-sectional view of the package, shown in FIG. 9, in the normal-pressure environment.

Next, there will be described a fifth embodiment of the present invention by reference to FIGS. 9, 10A, and 10B. FIGS. 9, 10A, and 10B illustratively show a construction of a package 130 as the fifth embodiment. The same reference numerals as used in the first embodiment are used to designate the corresponding elements of the fifth embodiment, and the description thereof is omitted.

In the first embodiment, the packing bag 12 whose external shape is corrected by the inner box 11 is contacted with the inner surfaces of the outer box 13, or is kept away from the outer box 13 via small gaps only. In contrast, in the fifth embodiment, an air-filled bag as a gas-tight bag is additionally provided between a packing bag 12 and an outer box 13.

The package 130 includes the sealing case 7 carrying the recording head 1, and a different packing kit 20 that packs the sealing case 7. In the fifth embodiment, the packing kit 20 includes an inner box 11, a packing bag 12, and an outer case 13. In the package 130, the sealing case 7 carrying the recording head 1 is accommodated by the inner box 11, the inner box 11 is fluid-tightly accommodated by the packing bag 12, and the bag 12 is accommodated by the outer box 13. FIG. 9 shows the package 130 in a state thereof before the packing bag 12 is accommodated by the outer box 13.

The packing bag 12 is subjected to heat seal, i.e., thermal fusion to form a seal portion 12*e* including a first seal portion 12*e*1 and a second seal portion 12*e*2. More specifically described, two flexible film sheets are thermally fused to form the seal portion 12*e* having a pre-selected width and thereby provide the packing bag 12.

The first seal portion 12*e*1 is formed in an intermediate portion of the packing bag 12, located above the inner box 11 and near to the top portion of the same 11, such that the first seal portion 12*e*1 linearly extends from one of widthwise opposite ends of the bag 12 to the other end thereof. The second seal portion 12*e*2 is formed at the open end 12*a* of the packing bag 12, located above the inner box 11, such that the second seal portion 12*e*2 linearly extends from one of widthwise opposite ends of the bag 12 to the other end thereof.

The first and second seal portions 12*e*1, 12*e*2 cooperate with each other to separate the packing bag 12 into a lower, packing chamber 12*g* and an upper, air chamber 12*f*. The packing chamber 12*g* is a fluid-tight chamber that is fluid-tightly closed by the first seal portion 12*e*1 and that accommodates the inner box 11. The air chamber 12*f* is a gas-tight chamber that is gas-tightly closed by the first and second seal portions 12*e*1, 12*e*2 and is filled with air. In the present embodiment, the packing chamber 12*g* constitutes a packing bag, and the air chamber 12*f* constitutes a gas-tight bag. That is, the air chamber (i.e., the gas-tight bag) 12*f* is formed as an integral portion of the packing bag 12, by utilizing a surplus portion of the packing chamber (i.e., the packing bag) 12*g* that accommodates the inner box 11. In the fifth embodiment, the air chamber 12*f* is located in a space left between the upper surface of the inner box 11 and the inner surface of the top portion of the outer box 13.

FIGS. 10A and 10B show an internal construction of the package 130 as seen in a direction indicated by "B" in FIG. 9. More specifically described, FIG. 10A shows a condition of the package 130 in a normal-pressure environment (i.e., about 1 atm); and FIG. 10B shows a condition of the package 130 in a low-pressure environment.

As shown in FIG. 10A, the packing bag 12 fluid-tightly accommodating the inner box 11 is accommodated by the outer box 13. Like the first embodiment, the fifth embodiment is adapted such that the sealing case 7 carrying the recording head 1 is accommodated by the inner box 11. Therefore, the bottom and side portions of the inner box 11 correct an external shape of the packing chamber 12*g* of the packing bag 12 into a corrected shape approximating respective internal shapes of the bottom and side portions of the outer box 13. Thus, almost all portions of bottom and side portions of the packing chamber 12*g* that are opposed to the bottom and side portions of the outer box 13 are contacted with the inner surfaces of the outer box 13. The upper surface of the inner box 11 is distant in a downward direction from the inner surface of the top portion of the outer box 13 by a pre-selected distance. The top portion of the inner box 11 corrects an external shape of a top portion of the packing chamber 12*g* to a corrected shape approximating an internal shape of the top portion of the outer box 13, and keeps the top portion at a position distant downward from the inner surface of the top portion of the outer box 13 by a pre-selected distance.

The packing bag 12 is folded at the first seal portion 12*e*1, so that the air chamber 12*f* is superposed on the packing chamber 12*g* at a position right above the inner box 11. In this state, a gap is left between an upper surface of the air chamber 12*f* and the inner surface of the top portion of the outer box 13.

FIG. 10B shows a condition of the package 130, shown in FIG. 10A, in a low-pressure environment (i.e., about 0.7 atm). In the low-pressure environment, the air pressure inside of the packing bag 12 becomes higher than the air pressure outside of the bag 12, so that the bag 12 inflates. When the air chamber 12*f* inflates, the upper portion of the air chamber 12*f* contacts the inner surface of the top portion of the outer box 13, and the lower portion of the same 12*f* contacts the packing chamber 12*g*. Thus, even though the packing chamber (i.e., the packing bag) 12*g* may not directly contact the top portion of the outer box 13, the outer box 13 can restrain or control the inflation of the packing chamber 12*g* via the air chamber (i.e., the gas-tight bag) 12*f*.

The external shape of the packing bag 12 can be corrected to a corrected shape most accurately approximating the internal shape of the outer box 13, if the bag 12 is located at a position where the bag 12 is closely contacted with the inner surfaces of the outer box 13, i.e., the entire outer surface of the bag 12 is contacted with the inner surfaces of the outer box 13. In this state, the inflation of the packing bag 12 can be minimized. However, in order that the packing bag 12 may be located at the position where the entire outer surface of the bag 12 is contacted with the inner surfaces of the outer box 13, it is needed to work (or produce) the inner box 11 with high accuracy with respect to its external dimensions relative to the internal dimensions of the outer box 13.

In contrast, in the fifth embodiment, the inflation of the packing chamber 12*g* is restrained by the outer box 13 via the air chamber 12*f* filling the gap left between the packing chamber 12*g* and the top portion of the outer box 13. Thus, it is not needed to control strictly the external dimensions of the inner box 11 and the internal dimensions of the outer box 13. Therefore, the packing kit 20 can be easily produced.

However, the air chamber 12*f* as the gas-tight bag may not be located above the inner box 11. For example, the gas-tight bag may be located in a gap left between the bottom portion, or an arbitrary one of the side portions, of the inner box 11 and the outer box 13.

In the fifth embodiment, the air chamber 12*f* as the gas-tight bag is formed as an integral portion of the packing chamber 12*g*. However, the gas-tight bag may be formed separately from the packing chamber 12*g* as the packing bag, and may be located in a gap left between a portion of the bag 12 and a corresponding inner surface of the outer box 13 that is opposed to that portion of the bag 12.

In the fifth embodiment, the inner box 11 as the bag correcting device may be omitted. That is, the packing kit 20 may be modified to include the packing bag 12 (or the packing chamber 12*g*) for fluid-tightly accommodating the sealing case 7, the air chamber 12*f*, and the outer box 13. In this modified form, a total number of components of the packing kit 20 can be reduced, and accordingly the packing kit 20 that can substantially maintain the air pressure in the bag 12 in the low-pressure environment can be produced at low cost.

Figure 11:
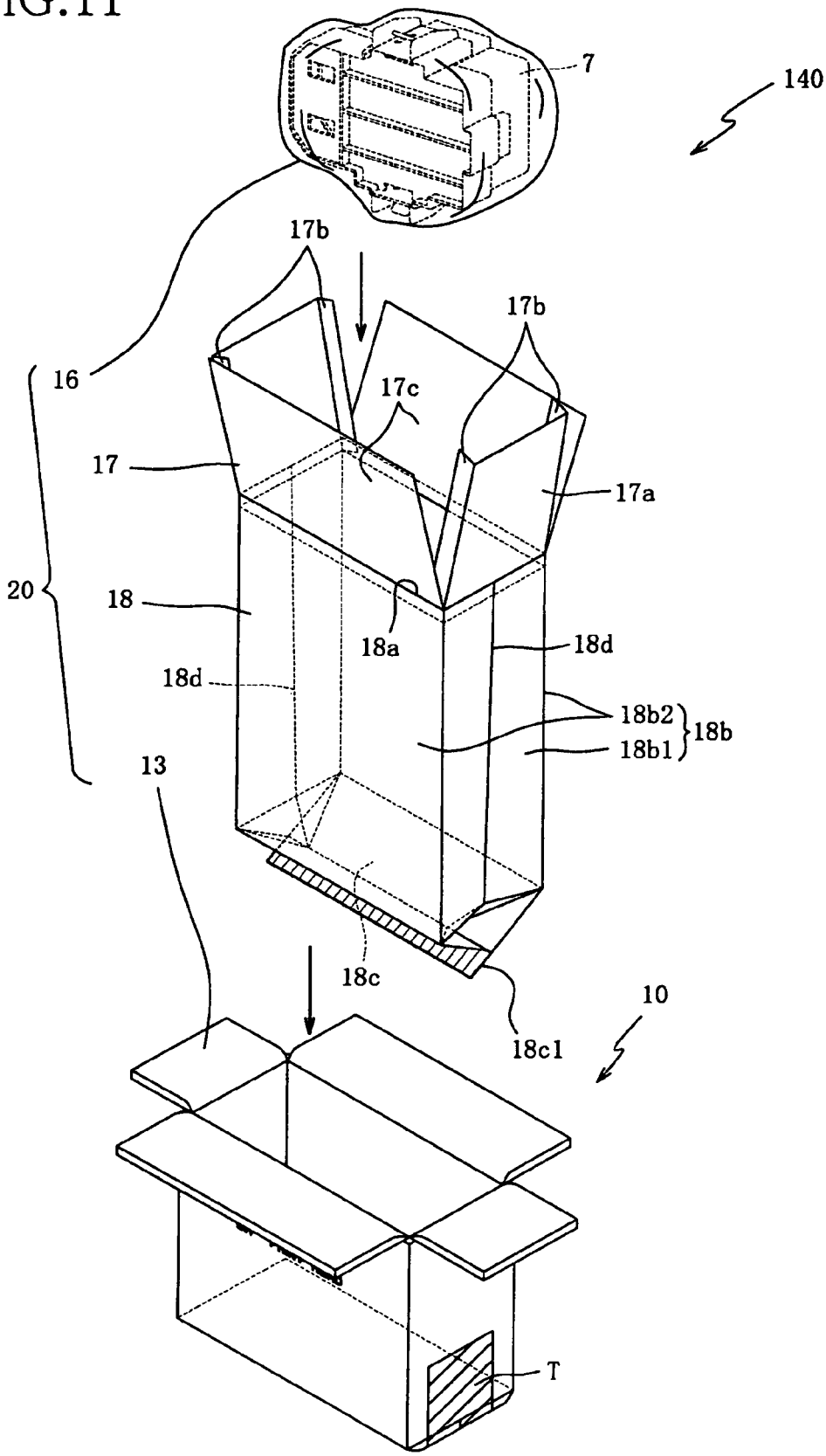
FIG. 11 is an exploded, perspective view of a construction of another package obtained in a sixth embodiment of the present invention.

Next, there will be described a sixth embodiment of the present invention by reference to FIG. 11. FIG. 11 shows a construction of a package 140 as the sixth embodiment. The same reference numerals as used in the first embodiment are used to designate the corresponding elements of the sixth embodiment, and the description thereof is omitted.

In the first embodiment, shown in FIG. 2A, the packing kit 20 used to obtain the package 10 includes, as the packing bag that fluid-tightly accommodates the sealing case 7 (or the inner box 11 that accommodates the sealing case 7), the packing bag 12 that is obtained by sealing respective three sides of two rectangular film sheets. In addition, the packing kit 20 includes, as the bag correcting device that corrects the external shape of the packing bag 12, the hexahedral inner box 11 having the upper surface, the bottom surface, and the four side surfaces. In contrast, in the sixth embodiment, a packing kit 20 of the package 140 includes, as the packing bag that fluid-tightly accommodates the sealing case 7, a so-called "gadget bag" 18. The gadget bag 18 takes a substantially rectangular-parallelepiped shape when it is inflated. The packing kit 20 of the package 140 additionally includes, as the bag correcting device that corrects the external shape of the packing bag, a developable member 17 having a bottom portion and four side portions, i.e., five portions in total.

The packing kit 20 used to obtain the package 140 as the sixth embodiment includes an outer box 13 identical with the outer box 13 used in the first embodiment shown in FIG. 2A; the above-described developable member 17 and gadget bag 18; and a flexible wrapping sheet 16 identical with the flexible wrapping sheet 16 used in the fourth embodiment shown in FIG. 8. In the sixth embodiment, the sealing case 7 is accommodated by the developable member 17, in a state in which the sealing case 7 is wrapped in the wrapping sheet 16. In the sixth embodiment, however, the wrapping sheet 16 may be omitted.

The developable member 17 accommodates the sealing case 7, as described above, and constitutes a bag correcting device that corrects the external shape of the gadget bag 18 that fluid-tightly accommodates the sealing case 7. More specifically described, the developable member 17 is formed of paper, like the inner box 11 used in the first embodiment, and has a substantially rectangular bottom portion 17*d* and four substantially rectangular side portions 17*a*, 17*c* that are continuous with four sides of the bottom portion 17*d*, respectively. Each of the four side portions 17*a*, 17*c* is foldable or pivotable at or about a corresponding one of the four sides of the bottom portion 17*d*, so as to be upright relative to the bottom portion 17*d*. Thus, the developable member 17 has a box-like, substantially rectangular parallelepiped shape having an upper opening.

Each of the two shorter side portions 17*a* has, along two opposite edges thereof, two marginal portions 17*b* each having a pre-selected width. More specifically described, the four marginal portions 17*b* extend outward from of the two side portions 17*a*, and are folded inward. In the state in which the four side portions 17*a*, 17*c* are upright relative to the bottom portion 17*d*, the four marginal portions 17*b* are aligned with respective inner surfaces of the two longer side portions 17*c*. Each of the bottom and side portions 17*d*, 17*a*, 17*c* of the developable member 17 have the same dimensions as those of a corresponding one of the bottom and side portions of the inner box 11, shown in FIG. 2A.

As shown in FIG. 11, the four side portions 17*a*, 17*c* of the developable member 17 are not adhered to each other, and each of the side portions 17*a*, 17*c* is pivotable about a corresponding one of the four sides of the bottom portion 17*d*. That is, the developable member 17 is used in the state in which the four side portions 17*a*, 17*c* thereof are not adhered to each other. Therefore, an inner volume of the developable member 17 can be changed by adjusting an angle that is contained by each of the side portions 17*a*, 17*c* and the bottom portion 17*d*. Therefore, variations of respective dimensions of individual sealing cases 7, each wrapped in the wrapping sheet 16, can be compensated for by adjusting the shape of the developable member 17. Thus, even though the respective dimensions of the individual sealing cases 7 may not be strictly controlled, each of the sealing cases 7 can be easily accommodated by the developable member 17. In addition, the external shape of the developable member 17 can be adjusted so as to be adapted to the internal shape of the outer box 13. That is, since the developable member 17 is used as the bag correcting device that corrects the external shape of the gadget bag 18 into the corrected shape approximating the internal shape of the outer box 13, the external shape of the gadget bag 18 can be easily corrected without needing to control strictly the respective shapes (i.e., dimensions) of the outer case 13 and the developable member 17.

The gadget bag 18 naturally takes a substantially rectangular-parallelepiped shape when it is inflated and, in this initial state of the bag 18, an upper end 18*a* of the bag 18 is open. A dimension of the gadget bag 18 in a lengthwise direction thereof (i.e., in a direction from a bottom portion 18*c* thereof toward the upper open end 18*a* thereof) is about twice a height Z2 of the outer case 13. Therefore, in the state in which the sealing case 7 is accommodated by the gadget bag 18, respective upper portions of four side portions 18*b* of the bag 18 can be folded inward onto each other so as to close the upper open end 18*a*. However, the length of the gadget bag 18 may not be limited to twice the height Z2 of the outer case 13, so long as the respective upper portions of the four side portions 18*b* of the bag 18 can be folded onto each other in the state in which the sealing case 7 is accommodated by the bag 18.

In a state before the gadget bag 18 is inflated, each of two narrower side portions 18*b*1 of the bag 18 is folded inward at a centerline 18*d* thereof so as to have a generally M-shaped cross section. That is, the two narrower side portions 18*b*1 are in a folded-up state. In addition, the bottom portion 18*c* of the gadget bag 18 is subjected to thermal fusion to have an end seal 18*c*1 extending from one of widthwise opposite ends thereof to the other end. Thus, one of two half portions of the bottom portion 18*c*, located on either side of the end seal 18*c*1, is flush with one of two wider side portions 18*b*2 of the gadget bag 18, and the other half portion of the bottom portion 18*c* is flush with the other wider side portion 18*b*2.

When, in the initial state of the gadget bag 18, the developable member 17 is inserted into the bag 18, the bottom portion 17*d* of the developable member 17 is used to open the open end 18*a*, and unfolds the two narrower side portions 18*b*1, of the bag 18. Thus, respective lower end portions of each of the two narrower side portions 18*c*1, located on the side of the bottom portion 18*c*, are folded onto the bottom portion 18*c*, while forming two triangular portions that have a common vertex at a point where the end seal 18*c*1 meets a corresponding one of the two centerlines 18*d*. Thus, each of the two narrower side portions 18*b*1 is developed into a flat portion having a substantially rectangular outer surface. In addition, the above-described two half portions of the bottom portion 18*c*, located on either side of the end seal 18*c*1, are developed into a flat portion having a substantially rectangular outer surface. Thus, the external shape of the gadget bag 18 is corrected into a corrected shape having a substantially rectangular-parallelepiped shape having the two rectangular narrower side portions 18*b*1, the two rectangular wider side portions 18*b*2, the rectangular bottom portion 18*c*, and the upper open end 18*a*, as shown in FIG. 11.

Like the packing bag 12 used in the first embodiment, the gadget bag 18 is formed of a resin-based, flexible film sheet that can be thermally fusible. Therefore, the sealing case 7 can be fluid-tightly accommodated in the gadget bag 18, by subjecting the bag 18 to thermal function, i.e., thermally sealing the same 18.

Next, there will be described a method of packing the sealing case 7 by using the packing kit 20 employed in the sixth embodiment. First, the sealing case 7 that fluid-tightly seals the recording head 1 is wrapped in the wrapping sheet 16, and is thermally sealed. Next, the gadget bag 18 is prepared as follows: A sheet having a tubular shape is collapsed as if two rectangular sheets were stacked on each other and connected to each other at their widthwise opposite edges. Then, the two widthwise opposite edges are utilized as the above-described respective centerlines 18*d* of the two narrower side portions 18*b*1. More specifically described, the two narrower side portions 18*b*1 are folded inward at the respective centerlines 18*d*, and one of two lengthwise opposite open ends of the collapsed tubular sheet is subjected to thermal fusion to form the straight end seal 18*c*1 extending from one of widthwise opposite ends to the other end and thereby form the bottom portion 18*c*. The other open end constitutes the upper open end 18*a*. Then, a portion of the developable member 17 that includes the bottom portion 17*d* and has an appropriate length as measured from the portion 17*d*, is inserted into the gadget bag 18 through the open end 18*a* thereof, as shown in FIG. 11.

In this state, the sealing case 7 wrapped in the wrapping sheet 16 is placed in the developable member 17. Since the four side portions 17*a*, 17*c* of the developable member 17 are not adhered to each other, an upper end of the developable member 17 can be widely opened so as to receive easily the sealing case 7. Thus, the sealing case 7 wrapped in the wrapping sheet 16 can be easily placed in the developable member 17.

Subsequently, the gadget bag 18 is inserted, starting with the bottom portion 18*c* thereof, into the outer box 13. Then, the developable member 17 accommodating the sealing case 7 is inserted into the gadget bag 18, so that the developable member 17 with the sealing case 7 is placed on the bottom portion of the outer box 13 via the bottom portion 18*c* of the bag 18. Then, respective upper portions of the two narrower side portions 18*b*1 of the gadget bag 18, located above the developable member 17, are folded inward at the respective centerlines 18*d*, while air is discharged out of the bag 18 through the open end 18*a*. In addition, the respective upper portions of the four side portions 18*b* of the gadget bag 18 are subjected to thermal fusion or heat seal to close the open end 18*a* and thereby seal the bag 18. Then, the surplus portion of the gadget bag 18 that projects upward from the outer box 13 is folded up and is forcedly packed into the gap left in the outer box 13. Subsequently, the four lid portions of the outer box 13 that are now at their open positions are folded inward to close the upper open end of the outer box 13.

In the sixth embodiment, the packing bag that fluid-tightly accommodates the sealing case 7 is constituted by the gadget bag 18 that naturally takes the substantially rectangular-parallelepiped shape when it is inflated. Thus, the gadget bag 18 takes, as the initial, external shape thereof before being corrected by the developable member 17, the substantially rectangular-parallelepiped shape approximating the internal shape of the outer box 13. In this case, the change of the shape of the gadget bag 18, resulting from the correction of the shape by the developable member 17 as the bag correcting device, can be minimized. If the change of shape of the gadget bag 18 is large, then the bag 18 may largely loosen or flexed, which may lead to expanding the bag 18. In the sixth embodiment, the gadget bag 18 is used, and accordingly the loosing or flexing of the bag 18 after the correction of the developable member 17 can be minimized. Therefore, as compared with the cases where other sorts of bags are used, the expansion of the gadget bag 18 in the low-pressure environment can be strictly controlled or restrained.

In the sixth embodiment, the developable member 17 is constituted by the bottom portion 17*d* and the four side portions 17*a*, 17*c* each connected to the bottom portion 17*d*. However, the developable member 17 may be modified to have additionally a top portion. In this modified embodiment, the top portion may be constituted by a member that is separate from the developable member 17 and is detachably attached to the same 17; or an integral portion of the same 17 that extends upward from one of the four side portions 17*a*, 17*c*.

As is apparent from the foregoing description of the preferred embodiments of the present invention, when each of the packages 10, 100, 110, 120, 130, 140 each of which includes the recording head 1 as the fluid-containing container is transported in the low-pressure environment, the each package can maintain the inside air pressure of the fluid-tight inner space of the packing bag 12, 18 that fluid-tightly accommodates the recording head 1, at a pressure substantially equal to the normal atmospheric pressure. Thus, the inks contained by the ink tank 2 of the recording head 1 can be effectively prevented from leaking.

In the above-described embodiments, each of the inner box 11, the two flat members 14, the hard-urethane-foam pellets 15, the flexible wrapping sheet 16, and the developable member 17 constitutes the bag correcting device; and in the fifth embodiment shown in FIG. 9, the air chamber 12*f* constitutes the gas-tight bag. At least one of the bag correcting device and the gas-tight bag constitutes a volume-ratio reducing device that is provided inside of the outer box 13 as the non-gas-tight case, or inside of the packing bag 12, so as to reduce a ratio of a volume of the air present inside of the outer box 13 and outside of the packing bag 12, to a volume of the air present inside of the packing bag 12.

In the fifth embodiment shown in FIG. 9, the volume-ratio reducing device includes, in addition to the air chamber 12*f*, the inner box 11 as a bag correcting device that is provided inside of the packing chamber 12*g* and outside of the ink recording head 1 as the container and that corrects, in a state in which the packing chamber 12*g* is accommodated by the outer box 13 as the non-gas-tight case, the external shape of the packing chamber 12*g* into a corrected shape, and the air chamber 12*f* is provided in the inner space present between the packing chamber 12*g* and the outer box 13. In the low-pressure environment where the pressure of the air outside of the air chamber 12*f* is lower than the pressure of the air inside of the air chamber 12*f*, the expansion of the air chamber 12*f* is effectively restrained by the outer box 13, and accordingly the restrained expansion applies a pressing force to the packing chamber 12*g*, so as to restrain the expansion of the packing chamber 12*g*. That is, even if a space or gap may be left between the packing chamber 12*g* and the outer box 13, i.e., even if the packing chamber 12*g* and the outer box 13 may not be entirely contacted with each other, the expansion of the packing chamber 12*g* can be indirectly restrained by the outer box 13 via the air chamber 12*f*. Since the inner box 11 can be so constructed as to support a portion of the packing chamber 12*g* at a position away from a corresponding portion of the inner surface of the outer box 13 via a gap, the inner box 11 can be produced with a lower dimension accuracy than that with which the inner box 11, employed by the first embodiment shown in FIG. 2A, is produced to be able to correct the external shape of the packing bag 12 into the corrected shape approximating the internal shape of the outer box 13. If the packing chamber 12*g* is entirely contacted with the inner surface of the outer box 13, that is, if the inner box 11 supports the packing chamber 12*g* such that the entire outer surface of the packing chamber 12*g* is contacted with the inner surface of the outer box 13, the external shape of the packing chamber 12*g* can most accurately approximate the internal shape of the outer box 13 and accordingly minimize the expansion of the packing chamber 12*g*. However, to this end, the inner box 11 must be produced with a strict dimension accuracy with respect to designed dimensions corresponding to the dimensions of the internal shape of the outer box 13. For example, if the actual dimensions of the inner box 11 are smaller than the designed dimensions, the inner box 11 cannot correct the packing bag 12*g* such that the packing bag 12*g* is entirely contacted with the outer box 13; and if the actual dimensions of the inner box 11 are larger than the designed dimensions, the inner box 11 cannot be accommodated by the outer box 13. In the fifth embodiment, however, the inner box 11 is so constructed as to support a portion of the packing chamber 12*g* at a position away from a corresponding portion of the inner surface of the outer box 13 via a gap, and the air chamber 12*f* is provided in the gap. Therefore, the air chamber 12*f* can be reliably accommodated by the outer box 13, and the variations of dimensions of the inner box 11 can be absorbed by the air chamber 12*f*. Thus, the inner box 11 can be easily produced with a low dimension accuracy, and even if the thus produced inner box 11 may be used, the expansion of the packing chamber 12*g* can be effectively restrained.

In each of the first, second, and sixth embodiments, the outer box 13 has a substantially rectangular parallelepiped shape including a bottom surface, four side surfaces, and a top surface, and each of the inner box 11, the pair of flat members 14, and the developable member 17 as the bag correcting device includes at least two pairs of bag support portions which are respectively provided along at least two pairs of opposite sides each pair of which are opposite to each other in a corresponding one of at least two opposite surfaces which are selected from the bottom surface, the four side surfaces, and the top surface of the outer box 13 and are opposite to each other via the sealing case 7 or the recording head 1. The at least two pairs of bag support portions cooperate with each other to internally support the packing bag 12 and thereby correct the external shape of the packing bag 12 into the corrected shape approximating the internal shape of the outer box 13. Therefore, the external shape of the packing bag 12 can be easily corrected to approximate the internal shape of the outer box 13. If the packing bag 12 is located along the four side portions, the bottom portion, and the top portion of the outer box 13, the packing bag 12 takes a substantially rectangular parallelepiped shape. That is, the packing bag 12 is so supported as to have eight vertices of the rectangular parallelepiped shape. Therefore, the bag correcting device can be simply constituted by four bag support portions which are respectively provided along two pairs of opposite sides each pair of which are opposite to each other in a corresponding one of two opposite surfaces that are selected from the bottom surface, the four side surfaces, and the top surface of the rectangular parallelepiped shape of the outer box 13 and are opposite to each other via the sealing case 7. Each of the four bag support portions may be a simple columnar member such as a cylinder or a prism. Since the bag correcting device has a simple construction, it can be easily produced. In addition, in the case where the bag correcting device has a simple construction, it occupies only a small space or volume in the packing bag 12, and accordingly a large amount of gas can be accommodated by the packing bag 12 in the normal-pressure environment. Therefore, even if the packing bag 12 may have a certain degree of gas permeability, a rate of lowering of the pressure of the gas present in the packing bag 12 in the low-pressure environment can be reduced. The bag correcting device may be constituted by two frame members which are located along two opposite surfaces of the rectangular parallelepiped shape of the outer box 13, respectively, and each of which has an inner opening formed through a thickness thereof. A total area of portions of the packing bag 12 that are supported by the two frame members is larger than a total area of portions of the packing bag 12 that are supported by the four columnar members. Therefore, the bag correcting device including the two frame members can support the packing bag 12 in a better manner.

In the second embodiment shown in FIG. 6, the outer box 13 has a substantially rectangular parallelepiped shape including a bottom surface, four side surfaces, and a top surface, and the bag correcting device includes the two flat members 14 which are opposed to two opposite surfaces, respectively, which are selected from the bottom surface, the four side surfaces, and the top surface of the outer box 13 and are opposite to each other via the seal case 7. Each of the two flat members 14 has a size not greater than a size of each of the two opposite surfaces. Thus, the packing bag 12 can be supported by respective surfaces of the two flat members 14. Therefore, an area of portions of the packing bag 12 that are supported by the two flat members 14 is larger than the area of portions of the packing bag 12 that are supported by the four columnar members or the two frame members. The packing bag 12 may be formed of a flexible sheet. Therefore, the packing bag 12 is not required to have an external shape identical with the internal shape of the outer box 13. Even if a packing bag 12 having a size larger than the internal shape of the outer box 13 may be used, the packing bag 12 can be so folded up as to be accommodated by the outer case 13. Since packing bags 12 having different sizes can be employed as a member of the packing kit 20, the packing kit 20 can be easily produced at low cost. However, if the packing bag 12 includes one or more portions that is or are not closely contacted with the bag correcting device, that portion or those portions are likely to loosen. If that portion or those portions of the packing bag 12 loosens or loosen inward, i.e., away from the outer case 13, an amount of expansion of the packing bag 12 in the low-pressure environment increases to disadvantage. In the second embodiment, however, the bag correcting device in the form of the two flat members 14 supports the large area or portion of the packing bag 12. Therefore, the inward loosening of the packing bag 12 can be effectively prevented. Thus, the amount of expansion of the packing bag 12 in the low-pressure environment can be restrained using the packing kit 20 that can be produced at low cost.

In the first embodiment shown in FIG. 2A, the non-gas-tight outer box 13 has a substantially rectangular parallelepiped shape including a bottom surface, four side surfaces, and a top surface, and the inner box 11 also has a substantially rectangular parallelepiped shape including a bottom surface, four side surfaces, and a top surface. The inner box 11 has a size assuring that the inner box 11 is accommodated by the outer box 13. Therefore, the inner box 11 as the bag correcting device can correct the external shape of the packing bag 12 so as to minimize the difference between the external shape of the packing bag 12 and the internal shape of the outer box 13. Therefore, the inner box 11 can correct the external shape of the packing bag 12 so as to more accurately approximate the internal shape of the outer box 13, than any of the four columnar members, the two frame members, or the two flat members 14, i.e., any other bag correcting device whose external shape is not similar to the internal shape of the outer box 13. Thus, the inner box 11 can more effectively restrain the change of the volume (or the inside air pressure) of the packing bag 12 in the low-pressure environment than any other bag correcting device whose external shape is not similar to the internal shape of the outer box 13.

In the sixth embodiment shown in FIG. 11, the outer box 13 has a substantially rectangular parallelepiped shape including a bottom surface, four side surfaces, and a top surface, and the developable member 17 constitutes a shape-changeable member as the bag correcting device that includes a bottom portion approximating the bottom surface of the outer box 13, and four side portions approximating the four side surfaces of the rectangular parallelepiped shape of the outer box 13, respectively. Each of the four side portions of the developable member 17 is connected to the bottom portion thereof at a corresponding one of four sides thereof, such that the each side portion is pivotable about the one side and, in a state in which the four side portions of the developable member 17 extend in a direction substantially perpendicular to the bottom portion thereof, the developable member 17 takes a substantially rectangular parallelepiped shape having an open end. In the state in which the developable member 17 takes the substantially rectangular parallelepiped shape having the open end, the sealing case 7 as the container is placed in the inner space of the rectangular parallelepiped shape, and then is accommodated by the gadget bag 18 as the packing bag. Therefore, one or more of the four side portions of the developable member 17 can be pivoted outward, i.e., toward the outer box 13, so as to expand the rectangular parallelepiped shape. Thus, a gap corresponding to a difference of the external shape of the developable member 17 and the internal shape of the outer box 13 can be reduced by adjusting, as needed, the shape of the developable member 17 so that the adjusted shape corresponds to the internal shape of the outer box 13. Therefore, the developable member 17 and the outer box 13 can be produced with a considerably low dimension accuracy, because the difference of the respective sizes of the two members 17, 13 can be absorbed by the flexibility of the shape of the developable member 17. Thus, the developable member 17 and the outer box 13 can be easily produced.

In the sixth embodiment shown in FIG. 11, the packing bag in the form of the gadget bag 18 takes, when being inflated, a substantially rectangular parallelepiped shape having an open end. That is, when the developable member 17 as the bag correcting device is inserted into the gadget bag 18 so as to inflate the same 18, the gadget bag 18 takes the substantially rectangular parallelepiped shape having the open end. In the case where the external shape of the packing bag is corrected to approximate the internal shape of the outer box 13, if the original shape of the packing bag more or less differs from the internal shape of the outer box 13, the corrected external shape of the packing bag macroscopically resembles the internal shape of the outer box 13 but, microscopically, loosening or flexing occurs to one or more portions of the packing bag. That portion or those portions of the packing bag will expand outward in the low-pressure environment. In the sixth embodiment, however, the packing bag is constituted by the gadget bag 18 whose external shape can be formed to approximate the internal shape of the outer box 13 even in a state in which the gadget bag 18 is not corrected by the developable member 17. Therefore, even if the gadget bag 18 may be corrected by the developable member 17, the external shape of the gadget bag 18 is not largely distorted. Thus, the gadget bag 18 whose external shape is corrected by the developable member 17 can be prevented from being loosened or flexed and accordingly the expansion of the gadget bag 18 can be effectively restrained.

In the third embodiment shown in FIG. 7, the hard-urethane-foam pellets 15 constitutes a filler as the bag correcting device, and the filler cooperates with air to fill an inner space present between the sealing case 7 and the packing bag 12. Thus, the filler can be used to internally inflate the packing bag 12 so that the packing bag 12 is located along the inner surface of the outer box 13 and the external shape of the packing bag 12 approximates the internal shape of the outer box 13. Consequently the change of the volume (or the inside air pressure) of the packing bag in the low-pressure environment can be reduced. In addition, generally, a filler can take various shapes corresponding to various shapes of spaces and thereby efficiently fill each of those spaces. Therefore, the filler can be used irrespective of the respective shapes of the sealing case 7 and the outer box 13, and it is not needed to employ various bag correcting devices having different dimensions corresponding to the external shape of the sealing case 7 and the internal shape of the outer box 13. In other words, if a filler having a certain industrial standard is used as the bag correcting device, then the bag correcting device can be used irrespective of the respective shapes of the sealing case 7 and the outer box 13. Thus, the bag correcting devices as parts of the packing kits 20 can be controlled with ease and at low cost.

In the fourth embodiment shown in FIG. 8, the flexible wrapping sheet 16 in which the sealing case 7 is wrapped constitutes the bag correcting device, and cooperates with air to fill an inner space present between the sealing case 7 and the packing bag 12. The sealing case 7 or the recording head 1, wrapped in the flexible wrapping sheet 16, is inserted into the packing bag 12 so as to inflate the packing bag 12. Thus, the external shape of the packing bag 12 can be corrected to approximate the internal shape of the outer box 13. Consequently the change of the volume (or the inside air pressure) of the packing bag 12 in the low-pressure environment can be effectively reduced.

In the third embodiment shown in FIG. 7, the hard-urethane-foam pellets or chips 15 as the bag correcting device are a porous material having a multiplicity of pores. Therefore, the packing bag 12 can fluid-tightly accommodate a greater amount of air as compared with a case where a bag correcting device that has the same shape and volume as those of the urethane-foam pellets 15 but is not formed of a porous material is used. Therefore, even if the packing bag 12 may have a certain degree of gas permeability, a rate of lowering of the inside air pressure of the packing bag 12 can be decreased.

In the first embodiment shown in FIG. 2A, the packing bag 12 has a size larger than the external shape of the sealing case 7 as the container and, in the state in which the sealing case 7 is held in the lower portion of the packing bag 12, the upper, surplus portion of the packing bag 12 is not occupied by the sealing case 7, and has the opening 12*a*. The air-discharge passage 12*b* as a communication passage is formed while the surplus portion of the packing bag 12 is fluid-tightly sealed from the opening 12*a* to an intermediate position in the vicinity of the sealing case 7, in a lengthwise direction of the bag 12 away from the opening 12*a*, and is additionally fluid-tightly sealed from the intermediate position to one of opposite ends of the packing bag 12 in a widthwise direction of the bag 12 that is perpendicular to the lengthwise direction. Therefore, an appropriate amount of air can be easily discharged from the packing bag 12 through the air-discharge passage 12*b*. In addition, the final, fluid-tight closing of the packing bag 12 can be carried out by sealing the air-discharge passage 12*b* at any portion thereof. Thus, the closing of the packing bag 12 can be carried out with reliability.

While the present invention has been described in its preferred embodiments, the present invention may be otherwise embodied.

For example, in each of the above-described embodiments, the inks are charged into the ink tank 2 of the recording head 1, when the recording head 1 is shipped from the factory. However, a different sort of fluid such as a different sort of liquid (e.g., a maintenance liquid) may be charged into the ink tank 2.

In addition, in each of the above-described embodiments, the packing kit 20 is used to pack the recording head 1 as a fluid-containing container. However, the principle of the present invention is applicable to the art of packing various sorts of fluid-containing containers other than the recording head 1. For example, the present invention is applicable to an ink cartridge that stores an ink to be supplied to the recording head 1 and that is detachably attached to the ink-jet recording device.

As far as the present application is concerned, a fluid is not limited to a liquid but it encompasses any matter that can flows in, or leak from, a container. Therefore, the fluid may be a gas or a solid. The solid as the fluid may be fine particles or powder, such as a toner.

While the present invention has been described in detail in its embodiments, it is to be understood that the present invention is not limited to the details of those embodiments and may be embodied with various changes and improvements, such as those described in SUMMARY OF THE INVENTION, which may occur to a person skilled in the art.

What is claimed is:

1. A packing kit for packing a container which contains a fluid together with a first gas, and thereby providing a package including the container, the packing kit comprising:

a packing bag which is adapted to fluid-tightly accommodate the container together with a second gas;

a non-gas-tight case which accommodates the packing bag together with a third gas and which has a rigidity to restrain an expansion of the packing bag in a low-pressure environment where a portion of the third gas leaks from the non-gas-tight case and accordingly a pressure of the third gas becomes lower than a pressure of the second gas; and a volume-ratio reducing device which is provided inside of at least the non-gas-tight case so as to reduce a ratio of a volume of the third gas to a volume of the second gas.

2. The packing kit according to claim 1, wherein the volume-ratio reducing device comprises a bag correcting device which is provided inside of the packing bag and outside of the container and which corrects, in a state in which the packing bag is accommodated by the non-gas-tight case, an external shape of the packing bag into a corrected shape approximating an internal shape of the non-gas-tight case.

3. The packing kit according to claim 1, wherein the volume-ratio reducing device comprises a gas-tight bag which gas-tightly accommodates a fourth gas and which is provided inside of the non-gas-tight case and outside of the packing bag.

4. The packing kit according to claim 3, wherein the volume-ratio reducing device further comprises a bag correcting device which is provided inside of the packing bag and outside of the container and which corrects, in a state in which the packing bag is accommodated by the non-gas-tight case, an external shape of the packing bag into a corrected shape, and wherein the gas-tight bag is provided in an inner space present between the packing bag and the non-gas-tight case.

5. The packing kit according to claim 2, wherein the non-gas-tight case comprises a box having a substantially rectangular parallelepiped shape including a bottom surface, four side surfaces, and a top surface, wherein the bag correcting device comprises at least two pairs of bag support portions which are respectively provided along at least two pairs of opposite sides each pair of which are opposite to each other in a corresponding one of at least two opposite surfaces which are selected from the bottom surface, the four side surfaces, and the top surface of the box and are opposite to each other via the container in a state in which the container is accommodated in the packing bag, and wherein said at least two pairs of bag support portions cooperate with each other to internally support the packing bag and thereby correct the external shape of the packing bag into the corrected shape approximating the internal shape of the box.

6. The packing kit according to claim 2, wherein the non-gas-tight case comprises a box having a substantially rectangular parallelepiped shape including a bottom surface, four side surfaces, and a top surface, wherein the bag correcting device comprises at least two flat members which are opposed to at least two opposite surfaces, respectively, which are selected from the bottom surface, the four side surfaces, and the top surface of the box and are opposite to each other via the container in a state in which the container is accommodated in the packing bag, and wherein each of said at least two flat members has a size not greater than a size of each of said at least two opposite surfaces.

7. The packing kit according to claim 2, wherein the non-gas-tight case comprises a first box having a substantially rectangular parallelepiped shape including a bottom surface, four side surfaces, and a top surface, and the bag correcting device comprises a second box having a substantially rectangular parallelepiped shape including a bottom surface, four side surfaces, and a top surface, and wherein the second box has a size assuring that the second box is accommodated by the first box.

8. The packing kit according to claim 2, wherein the non-gas-tight case comprises a box having a substantially rectangular parallelepiped shape including a bottom surface, four side surfaces, and a top surface, wherein the bag correcting device comprises a shape-changeable member which includes a bottom portion approximating the bottom surface of the box, and four side portions approximating the four side surfaces of the box, respectively, wherein each of the four side portions of the shape-changeable member is connected to the bottom portion thereof at a corresponding one of four sides thereof, such that said each side portion is pivotable about said one side, and wherein in a state in which the four side portions of the shape-changeable member extend in a direction substantially perpendicular to the bottom portion thereof, the shape-changeable member takes a substantially rectangular parallelepiped shape having an open end.

9. The packing kit according to claim 8, wherein the packing bag comprises a gadget bag which takes, when being inflated, a substantially rectangular parallelepiped shape having an open end.

10. The packing kit according to claim 2, wherein the bag correcting device comprises a filler which cooperates with the second gas to fill a space which is present between the container and the packing bag in a state in which the container is accommodated in the packing bag.

11. The packing kit according to claim 2, wherein the bag correcting device comprises a flexible sheet in which the container is wrapped and which cooperates with the second gas to fill a space which is present between the container and the packing bag in a state in which the container is accommodated in the packing bag.

12. The packing kit according to claim 2, wherein the bag correcting device is formed of a porous material having a multiplicity of pores.

13. The packing kit according to claim 1, wherein the non-gas-tight case is formed of a cardboard.

14. A package, comprising:

a container which contains a fluid together with a first gas; and the packing kit according to claim 1, wherein the packing kit packs the container and thereby provides a package including the container.

15. A method of packing, with the packing kit according to claim 1, a container which contains a fluid together with a first gas, and thereby providing a package including the container, the method comprising:

inserting, in a state in which the packing bag has an opening, at least the container into the packing bag through the opening thereof, closing the opening of the packing bag in a state in which a holding portion of the packing bag in which at least the container is held is communicated with an outside of the packing bag through a communication passage formed in the packing bag, placing, in a state in which the non-gas-tight case has an opening, the packing bag in the non-gas-tight case through the opening thereof, folding, in a state in which the packing bag is placed in the non-gas-tight case, a surplus portion of the packing bag, while discharging a surplus portion of the second gas from the packing bag through the communication passage thereof, and fluid-tightly closing the communication passage of the packing bag, and then closing the opening of the non-gas-tight case.

16. The method according to claim 15, wherein the inserting comprises inserting the container and the volume-ratio reducing device into the packing bag through the opening thereof, and the closing comprises closing the opening of the packing bag in a state in which the holding portion of the packing bag in which the container and the volume-ratio reducing device are held is communicated with the outside of the packing bag through the communication passage of the packing bag.

17. The method according to claim 15, wherein the placing comprises placing, before at least the container is inserted into the packing bag, the packing bag in the non-gas-tight case through the opening thereof.

18. The method according to claim 15, wherein the placing comprises placing, after at least the container is inserted into the packing bag, the packing bag in the non-gas-tight case through the opening thereof.

19. The method according to claim 15, wherein the packing bag is larger than an external shape of the container and, in a state in which the container is held in the holding portion of the packing bag, the surplus portion of the packing bag is not occupied by the container, and includes the opening thereof, and wherein the closing comprises forming the communication passage by fluid-tightly sealing the surplus portion of the packing bag from the opening thereof to an intermediate position in a vicinity of the container, in a first direction away from the opening, and additionally fluid-tightly sealing the packing bag from the intermediate position to one of opposite ends of the packing bag in a second direction intersecting the first direction.

20. A method of packing, with the packing kit according to claim 1, a container which contains a fluid together with a first gas, and thereby providing a package including the container, the method comprising:

inserting, in a state in which the packing bag has an opening, at least the container into the packing bag through the opening thereof, placing, in a state in which the non-gas-tight case has an opening, the packing bag in the non-gas-tight case through the opening thereof, and fluid-tightly closing, in a state in which the packing bag is placed in the non-gas-tight case, the opening of the packing bag, and then closing the opening of the non-gas-tight case.

21. The method according to claim 20, wherein the inserting comprises inserting the container and the volume-ratio reducing device into the packing bag.

22. The method according to claim 20, wherein the placing comprises placing, after at least the container is inserted into the packing bag, the packing bag in the non-gas-tight case through the opening thereof.

23. A package, comprising:

a container which contains a fluid together with a first gas; and a packing kit which packs the container, the packing kit including a packing bag which is formed of a flexible sheet and which fluid-tightly accommodates the container together with a second gas, a non-gas-tight case which accommodates the packing bag together with a third gas, and has a rigidity higher than a rigidity of the packing bag, so as to restrain an expansion of the packing bag in a low-pressure environment where a pressure of the third gas is lower than a pressure of the second gas, and a bag correcting device which is provided inside of the packing bag and outside of the container and which corrects, in a state in which the packing bag is accommodated by the non-gas-tight case, an external shape of the packing bag into a corrected shape approximating an internal shape of the non-gas-tight case.

24. A package, comprising:

a container which contains a fluid together with a first gas; and a packing kit which packs the container, the packing kit including a packing bag which is formed of a first flexible sheet and which fluid-tightly accommodates the container together with a second gas, a non-gas-tight case which accommodates the packing bag together with a third gas such that the non-gas-tight case has an inner space present outside of the packing bag, and a gas-tight bag which is formed of a second flexible sheet, gas-tightly accommodates a fourth gas, and is provided in the inner space of the non-gas-tight case.

* * * * *